US010828887B2

(12) United States Patent
Sakurada et al.

(10) Patent No.: US 10,828,887 B2
(45) Date of Patent: Nov. 10, 2020

(54) AUXILIARY LIQUID, LIQUID SET, IMAGE RECORDING METHOD AND IMAGE RECORDING APPARATUS

(71) Applicant: CANON KABUSHIKI KAISHA, Tokyo (JP)

(72) Inventors: Shinichi Sakurada, Tokyo (JP); Takashi Imai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/106,431

(22) Filed: Aug. 21, 2018

(65) Prior Publication Data

US 2018/0354256 A1 Dec. 13, 2018

Related U.S. Application Data

(62) Division of application No. 15/467,175, filed on Mar. 23, 2017, now Pat. No. 10,081,175.

(30) Foreign Application Priority Data

Mar. 31, 2016 (JP) ..... 2016-073083

(51) Int. Cl.
*B41J 2/005* (2006.01)
*B41J 2/01* (2006.01)

(52) U.S. Cl.
CPC ..... *B41J 2/0057* (2013.01); *B41J 2002/012* (2013.01)

(58) Field of Classification Search
CPC ..... B41J 2/0057; B41J 2002/012
See application file for complete search history.

(56) References Cited

U.S. PATENT DOCUMENTS

| | | | | |
|---|---|---|---|---|
| 7,281,790 | B2 | 10/2007 | Mouri et al. | |
| 8,362,108 | B2 | 1/2013 | Imai | |
| 9,624,395 | B2 | 4/2017 | Kaji et al. | |
| 2002/0058193 | A1* | 5/2002 | Tosaka | G03G 5/0609 430/108.23 |
| 2015/0009268 | A1 | 1/2015 | Sakurada | |
| 2016/0075898 | A1 | 3/2016 | Imai et al. | |
| 2016/0075899 | A1 | 3/2016 | Imai et al. | |
| 2016/0200925 | A1 | 7/2016 | Kaji et al. | |
| 2016/0200929 | A1 | 7/2016 | Imai et al. | |
| 2016/0230030 | A1 | 8/2016 | Tominaga et al. | |
| 2016/0340535 | A1 | 11/2016 | Torisaka et al. | |
| 2016/0368285 | A1 | 12/2016 | Shinjo et al. | |

FOREIGN PATENT DOCUMENTS

| | | |
|---|---|---|
| JP | 4834300 B2 | 12/2011 |

* cited by examiner

*Primary Examiner* — Henok D Legesse
(74) *Attorney, Agent, or Firm* — Venable LLP

(57) ABSTRACT

A method of recording an image on a recording medium by applying an auxiliary liquid containing a water-soluble resin and wax particles to an intermediate image formed on an intermediate transfer member, bringing the intermediate image into contact with the recording medium at a temperature higher than a melting point of the wax particles, subsequently peeling off the intermediate image from the intermediate transfer member at a temperature lower than the melting point of the wax particles and transferring the intermediate image onto the recording medium. The method can improve the efficiency of transferring the intermediate image from the intermediate transfer member onto the recording medium.

13 Claims, 4 Drawing Sheets

1
2
3
4
5
6
7
8

AUXILIARY LIQUID, LIQUID SET, IMAGE RECORDING METHOD AND IMAGE RECORDING APPARATUS

This application is a division of application Ser. No. 15/467,175 filed Mar. 23, 2017, which claims priority from Japanese Patent Application No. 2016-073083, filed Mar. 31, 2016.

BACKGROUND OF THE INVENTION

Field of the Invention

This invention relates to an auxiliary liquid, a liquid set, an image recording method and an image recording apparatus.

Description of the Related Art

To date, inkjet recording apparatus have widely been utilized as computer-related output equipment in view of the advantages they provide including low running cost, downsizing feasibility and easy adaptability to color image recording using a plurality of color inks. In recent years, there has been a demand for image recording apparatus that can output high quality images at high speed regardless of kinds of the recording mediums to be used with them. In order to realize high speed and high quality image output capabilities, image degrading phenomena such as the phenomenon of so-called feathering that is caused by ink spreading along fibers of recording medium need to be suppressed.

As means that can solve the above-identified problem, image recording apparatus employing a transfer system with an intermediate transfer member are known. In an inkjet image recording apparatus employing a transfer system (to be referred to also as transfer type inkjet image recording apparatus hereinafter), an intermediate image is recorded on an intermediate transfer member by inject method. Then, the intermediate image on the intermediate transfer member is dried. Thereafter, a final image is formed on a recording medium as the dried intermediate image is transferred from the intermediate transfer member onto the recording medium. With an image recording method using an image transfer system, high quality images can be recorded at high speed on various recording mediums including recording paper and the problem of feathering that arises when images are directly output on recording mediums at high speed hardly appears.

For an image recording apparatus employing a transfer system to record high quality images on a recording medium, high transfer efficiency is required to the operation of transferring an intermediate image from the intermediate transfer member. How to achieve high transfer efficiency for intermediate images is an important challenge also from the viewpoint of recording high quality images at high speed.

For example, high transfer efficiency can hardly be achieved when there occur instances where part of the intermediate image on the intermediate transfer member is not transferred onto a recording medium and where an intermediate image is internally divided at the time of transfer and only part of the intermediate image is recorded on a recording medium while the remaining part of the intermediate image is left on the intermediate transfer member.

Japanese Patent No. 4,834,300 discloses an inkjet recording apparatus having an auxiliary liquid application unit applying an auxiliary liquid that contains water-soluble resin to the intermediate transfer member of the apparatus as means for improving the efficiency of transferring an intermediate image from the intermediate transfer member. The main purpose of providing such an auxiliary liquid application unit is to improve a scratch resistance of an image. Japanese Patent No. 4,834,300 also discloses application of an auxiliary liquid that contains a water-soluble resin after the formation of an intermediate image in order to assist the mutual adhesion of a recording medium and the intermediate image and consequently improve the transfer performance.

SUMMARY OF THE INVENTION

One aspect of the present invention is directed to providing an auxiliary liquid that can improve the efficiency of transferring an intermediate image onto a recording medium and enables to stably record images of desired quality on recording mediums, a liquid set including the auxiliary liquid, and an image recording method and an image recording apparatus using the auxiliary liquid.

According to one aspect of the present invention, there is provided an image recording method including the steps of: forming a first intermediate image including a step of applying an ink onto an intermediate transfer member and a step of applying a reaction solution containing an ink viscosity increasing component onto the intermediate transfer member; forming a second intermediate image by applying an auxiliary liquid containing a water-soluble resin and wax particles to the first intermediate image on the intermediate transfer member; and bringing the second intermediate image on the intermediate transfer member into contact with a recording medium, peeling off the second intermediate image from the intermediate transfer member while maintaining the contact between the second intermediate image and the recording medium, and transferring the second intermediate image onto the recording medium; wherein the method further including: adjusting a temperature Tc of the second intermediate image contacting the recording medium so as not to be lower than the melting point of the wax particles; and adjusting a temperature Tr of the second intermediate image to be peeled off from the intermediate transfer member so as to be lower than the melting point of the wax particles.

According to another aspect of the present invention, there is provided an image recording apparatus including: an image forming unit forming a first intermediate image, the image forming unit having a reaction solution application section applying a reaction solution containing an ink viscosity increasing component onto an intermediate transfer member, and an ink application section applying an ink onto the intermediate transfer member; an auxiliary liquid application device forming a second intermediate image by applying an auxiliary liquid containing a water-soluble resin and wax particles to the first intermediate image on the intermediate transfer member; and a transfer unit bringing the second intermediate image on the intermediate transfer member into contact with a recording medium, peeling off the second intermediate image from the intermediate transfer member while maintaining the contact between the second intermediate image and the recording medium, and transferring the second intermediate image onto the recording medium; wherein the apparatus further including: a first temperature adjusting section adjusting a temperature Tc of the second intermediate image contacting the recording medium so as not to be lower than the melting point of the wax particles; and a second temperature adjusting section adjusting a temperature Tr of the second intermediate image to be peeled off from the intermediate transfer member so as to be lower than the melting point of the wax particles.

According to still another aspect of the present invention, there is provided an auxiliary liquid for image transferring in transfer type image recording, containing a water-soluble resin and wax particles.

According to a further aspect of the present invention, there is provided a liquid set for transfer type image recording, the liquid set including an auxiliary liquid for image transfer containing a water-soluble resin and wax particles, and an ink.

Further features of the present invention will become apparent from the following description of exemplary embodiments with reference to the attached drawings.

DESCRIPTION OF THE EMBODIMENTS

Figure 1:
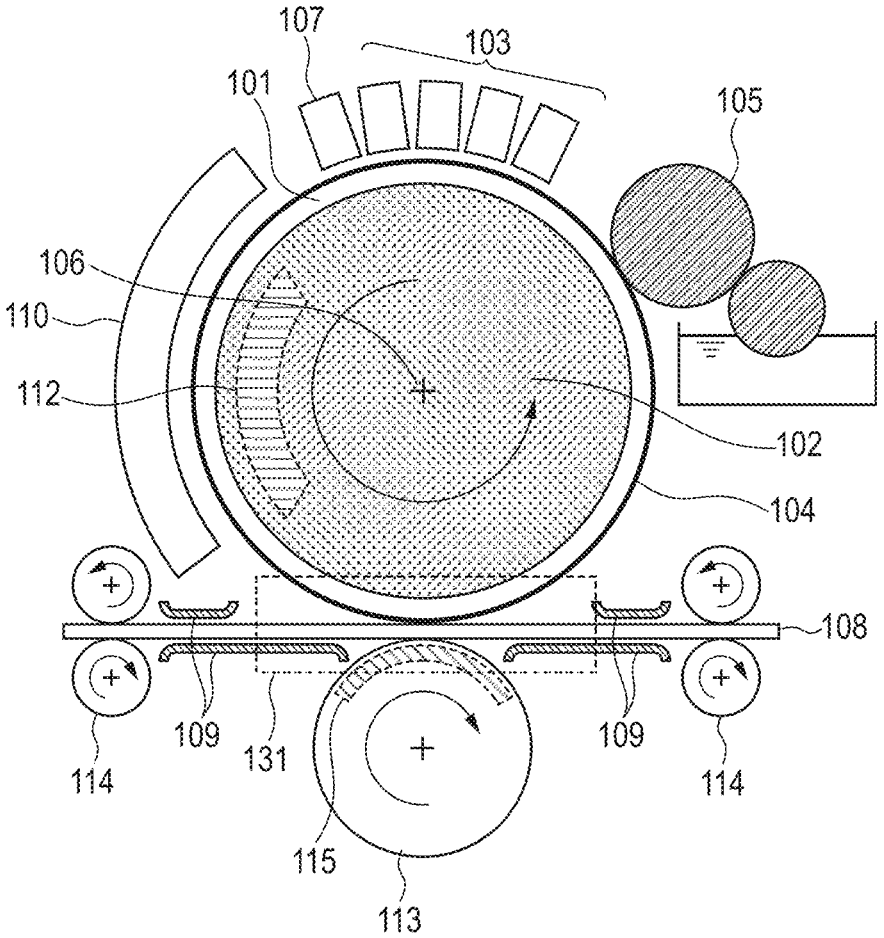
FIG. 1 is a schematic illustration of an embodiment of image recording apparatus according to one aspect of the present invention.

Preferred embodiments of the present invention will now be described in detail in accordance with the accompanying drawings.

As pointed out above, for a transfer type image recording apparatus to stably record high quality images, higher transfer efficiency is required to the operation of transferring an intermediate image from an intermediate transfer member onto a recording medium. For example, high transfer efficiency is required even when forming materials or forming conditions of intermediate images are different. The present invention has been made in view of the above circumstances.

An image recording method according to the present invention includes steps (A), (B) and (C) as described below.

(A) a step of forming a first intermediate image on an intermediate transfer member.

(B) a step of forming a second intermediate image by applying an auxiliary liquid containing a water-soluble resin and wax particles to the first intermediate image on the intermediate transfer member.

(C) a step of bringing the second intermediate image on the intermediate transfer member into contact with a recording medium, peeling off the second intermediate image from the intermediate transfer member while maintaining the contact between the second intermediate image and the recording medium, and transferring the second intermediate image onto the recording medium.

The auxiliary liquid is applied to the intermediate image formed on the intermediate transfer member in order to improve the transfer efficiency of transferring the intermediate image from the intermediate transfer member onto the recording medium. The improvement of the transfer efficiency of transferring the intermediate image by the auxiliary liquid is achieved by the addition of wax particles and a water-soluble resin contained in the auxiliary liquid to the intermediate image and also by the reinforcement of the adhesion of the intermediate image to the recording medium that is brought forth by melting and solidification of wax particles in the intermediate image. For the purpose of the present invention, an intermediate image before application of an auxiliary liquid thereto is referred to as a first intermediate image and an intermediate image after application of an auxiliary liquid thereto is referred to as a second intermediate image.

With an image recording method according to the present invention, a temperature adjustment operation of (D) and another temperature adjustment operation of (E) as described below are conducted in the transfer step.

(D) A temperature Tc of the second intermediate image contacting the recording medium is adjusted so as to be not lower than the melting point of the wax particles.

(E) A temperature Tr of the second intermediate image to be peeled off from the intermediate transfer member is adjusted so as to be lower than the melting point of the wax particles.

The temperature Tc of the second intermediate image is the temperature of the second intermediate image that is observed during the period when the second intermediate image is held in contact with the recording medium between the time when the second intermediate image is brought into contact with the recording medium and the time when the second intermediate image is peeled off from the intermediate transfer member. The expression of adjusting the temperature Tc of the second intermediate image so as not to be lower than the melting point of the wax particles includes instances where the temperature Tc of the second intermediate image is adjusted at least once so as not to be lower than the melting point of the wax particles during the period when the second intermediate image is held in contact with the recording medium. Differently stated, the temperature Tc may be adjusted so as not to be lower than the melting point of the wax particles throughout all the period when the second intermediate image is held in contact with the recording medium or only during a part of the period when the second intermediate image is held in contact with the recording medium.

The temperature Tr of the second intermediate image is the temperature of the second intermediate image that is observed at the time when the second intermediate image is peeled off from the intermediate transfer member, while the contact between the second intermediate image and the recording medium is maintained. It is sufficient for the temperature of the second intermediate image to be equal to temperature Tr when the second intermediate image is peeled off from the intermediate transfer member and, if the temperature is already at temperature Tr in a state where the second intermediate image is held in contact with the recording medium after the temperature is raised to temperature Tc and before the second intermediate image is peeled off from the intermediate transfer member, the second intermediate image may be peeled off while its temperature is at temperature Tr.

Presumably, a mechanism as described below is brought into effect to improve the adhesion between the second intermediate image and the recording medium as a result of adopting the temperature adjustment operations (D) and (E).

As a result of adopting the temperature adjustment operation (D), the second intermediate image can be brought into a state where it is held in contact with the recording medium and at the same time the second intermediate image is made to show the temperature Tc that is not lower than the melting point Tm of the wax particles (Tc≥Tm). The wax particles that are heated to the melting point thereof or higher in the second intermediate image are molten to raise its fluidity so that the molten wax spreads along the interface of the recording medium and the second intermediate image, and fills the gaps between them. Then, as a result, the tight adhesion between the recording medium and the second intermediate image is improved.

As the temperature requirement (Tr<Tm) is adopted for the temperature adjustment operation (E), the state of improved adhesion between the second intermediate image and the recording medium is stabilized when the wax component is solidified, so that consequently the adhesion between the second intermediate image and the recording medium is further improved. Then, as a result, the second intermediate image and the recording medium can hardly be separated from each other along the interface thereof.

Now, the presumed mechanism as mentioned above will be described further by referring to FIGS. 2A through 2D that illustrate a model of the mechanism.

FIGS. 2A through 2D illustrate a model of the mechanism when an ink containing a pigment as a coloring material and resin particles for improving the strength of the formed image and an auxiliary liquid containing a water-soluble resin, resin particles and wax particles are used to show how each of the ingredients behaves in the temperature adjustment operations of (D) and (E).

Figures 2A, 2B, 2C, 2D:
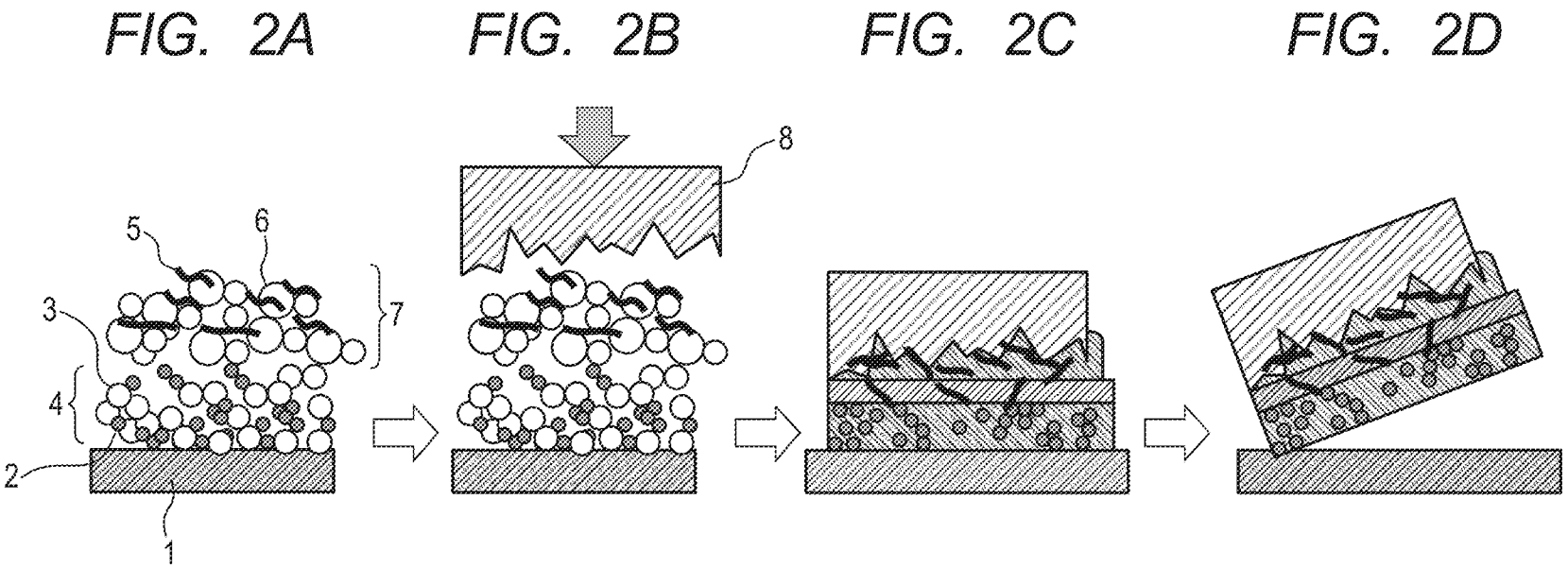
FIG. 2A is a schematic illustration of the action of an auxiliary liquid according to one aspect of the present invention in a state where a second intermediate image is being formed on an intermediate transfer member.
FIG. 2B is a schematic illustration of the action of an auxiliary liquid according to one aspect of the present invention in a state where a recording medium is being brought into contact with a second intermediate image.
FIG. 2C is a schematic illustration of the action of an auxiliary liquid according to one aspect of the present invention in a state where wax particles are molten and made to flow to fill gaps.
FIG. 2D is a schematic illustration of the action of an auxiliary liquid according to one aspect of the present invention in a state where a second intermediate image is being peeled off from an intermediate transfer member.

An ink agglomeration layer 4 is formed as the first intermediate image on the image forming surface of the intermediate transfer member 1. The ink agglomeration layer 4 contains the pigment 2 and resin particles 3. As the auxiliary liquid is applied onto the ink agglomeration layer 4, water-soluble resin 5, resin particles 3 and wax particles 6 are supplied to produce an auxiliary liquid agglomeration layer 7. Then, as a result, a second intermediate image having an internal structure as illustrated in FIG. 2A is obtained. Since the wax contained in the auxiliary liquid agglomeration layer is granular in shape, the wax can hardly get into the inside of the ink agglomeration layer 4 and hence is likely to be held only on the ink agglomeration layer 4. Subsequently, a recording medium 8 is brought into contact with the auxiliary liquid agglomeration layer 7 on the ink agglomeration layer 4. In this state, both the ink agglomeration layer 4 and the auxiliary liquid agglomeration layer 7 are heated to realize a temperature condition of Tc≥Tm and, at the same time, the recording medium 8 is pressed onto the auxiliary liquid agglomeration layer 7. The heating operation for realizing Tc≥Tm can be conducted in the state of FIG. 2B and/or in the state of FIG. 2C. Then, as a result, the wax particles 6 contained in the auxiliary liquid agglomeration layer 7 are molten and flow to fill the gaps along the interface of the recording medium 8 and the ink agglomeration layer 4 and bring forth a state where their mutual adhesion is improved as illustrated in FIG. 2C. Furthermore, a temperature condition of Tr<Tm is brought in to stabilize the state where their mutual adhesion is improved. Then, in this state of improved adhesion, the second intermediate image is peeled off from the intermediate transfer member 1 and transferred onto the recording medium 8 as illustrated in FIG. 2D.

At this time, since the auxiliary liquid agglomeration layer 7 contains water-soluble resin 5 along with wax particles 6, the water-soluble resin is also made to flow with the wax so as to cause the second intermediate image to firmly contact the recording medium and further improve the tight mutual adhesion thereof. Additionally, as the temperature Tr of the intermediate transfer member is adopted at the time of transferring the second intermediate image, the temperature of the second intermediate image rapidly falls after it is brought into contact with the recording medium to consequently put the wax into a solidified state so that the second intermediate image can hardly be peeled off from the recording medium along the interface thereof. Then, as a result, the efficiency of transferring the intermediate image onto the second recording medium is improved to presumably enable to execute the operation of transferring an excellent image on a stable basis.

The step of forming a first intermediate image on the intermediate transfer member includes a step of applying the reaction solution onto the intermediate transfer member and a step of applying an ink onto the intermediate transfer member. The reaction solution and the ink are applied to the intermediate transfer member such that the region where the reaction solution is applied at least partly overlaps with the region where ink is applied. The operation of applying the reaction solution to the intermediate transfer member can be conducted at least before the application of ink to the intermediate transfer member or after the application of ink to the intermediate transfer member, although the operation of applying the reaction solution to the intermediate transfer member is preferably conducted before the application of ink to the intermediate transfer member.

An inkjet technique can be used for the step of applying an ink to the intermediate transfer member.

Now, an image recording apparatus according to the present invention that is applicable to an image recording method according to the present invention will be described below.

An image recording apparatus according to the present invention includes (a), (b) and (c) as described below.

(a) an image forming unit for forming a first intermediate image on an intermediate transfer member.

(b) an auxiliary liquid application device for forming a second intermediate image by applying an auxiliary liquid containing a water-soluble resin and wax particles to the first intermediate image on the intermediate transfer member.

(c) a transfer unit for bringing the second intermediate image on the intermediate transfer member into contact with a recording medium, peeling off the second intermediate image from the intermediate transfer member while maintaining the contact between the second intermediate image and the recording medium, and transferring the second intermediate image onto the recording medium.

An image recording apparatus according to the present invention also has (d) and (e) as described below.

(d) a first temperature adjusting section for adjusting the temperature Tc of the second intermediate image contacting the recording medium so as not to be lower than the melting point of the wax particles.

(e) a second temperature adjusting section for adjusting a temperature Tr of the second intermediate image to be peeled off from the intermediate transfer member so as to be lower than the melting point of the wax particles.

The image forming unit forming a first intermediate image includes an ink application section applying an ink for forming an image onto the intermediate transfer member and a liquid application section applying a reaction solution to the intermediate transfer member. The viscosity of the ink for forming the first intermediate image can be increased by using at least the reaction solution from the liquid application section and the ink from the ink application section to form a first intermediate image. The ink application section can be provided with an inkjet head for ejecting the ink.

From the viewpoint of high-speed image transfer, a transfer unit having at least a pair of rollers that are disposed vis-à-vis is preferably employed in the step of transferring a second intermediate image onto a recording medium. The pair of rollers that are disposed vis-à-vis are driven to synchronously rotate and a nip section is arranged between the rollers. Then, a recording medium is laid on the second intermediate image that is held on the intermediate transfer member and they are inserted into and forced to pass through the nip section. Thus, the second intermediate image is pressed in the nip section in a state where it is held between the intermediate transfer member and the recording medium. In the nip section, the recording medium presses the second intermediate image so that the second intermediate image is forced to tightly adhere to the recording medium. After passing through the nip section, the intermediate transfer member and the recording medium are moved in respective directions so as to separate them from each other. Then, as a result, the second intermediate image is peeled off from the intermediate transfer member and transferred onto the recording medium.

Now, an embodiment of image recording method and an embodiment of image recording apparatus according to the present invention will be described below.

(Image Recording Apparatus)

FIG. 1 schematically illustrates an embodiment of image recording apparatus according to the present invention.

The image recording apparatus illustrated in FIG. 1 includes an intermediate transfer member 101 formed by a drum-shaped rotatable support member 102 and a surface layer member 104 arranged on the outer peripheral surface of the support member 102. The support member 102 is driven to rotate around shaft 106 in the direction indicated by the round arrow in FIG. 1 and various sections arranged around the support member 102 are made to operate in synchronism with the rotation of the support member 102.

The image forming unit of the apparatus illustrated in FIG. 1 has a roller type application device 105 that is a reaction solution application section applying a reaction solution to the image forming region on the outer peripheral surface of the intermediate transfer member 101 and an inkjet device 103 that is an ink application section applying an ink also onto the image forming region on the outer peripheral surface of the intermediate transfer member 101.

At the roller type application device 105, the reaction solution filled in a container for reaction solution is forced to move onto the outer peripheral surfaces of the rollers as the pair of rollers is driven to rotate. Then, the reaction solution is applied from the rollers rotating and in contact with the outer peripheral surface of the intermediate transfer member 101 onto the outer peripheral surface of the intermediate transfer member 101.

Note that the reaction solution is applied to the intermediate transfer member in such a manner that the region on the intermediate transfer member to which ink is supplied at least partly overlaps with the region to which the reaction solution is applied.

The inkjet devices 103 and 107 are arranged at the downstream side of the roller type application device 105 in the sense of rotation of the intermediate transfer member 101 so as to be located vis-à-vis the outer peripheral surface of the intermediate transfer member 101. The inkjet device 103 constitutes the ink application section having an inkjet recording device and inks containing respective coloring materials for forming an image are applied from the inkjet device 103 onto the image forming surface, which is the outer peripheral surface of the intermediate transfer member 101. The inkjet device 107 constitutes an auxiliary liquid application section and an auxiliary liquid is applied from the inkjet device 107 onto image forming surface, which is the outer peripheral surface of the intermediate transfer member 101. The inkjet devices 103 and 107 have respective inkjet heads.

Inkjet devices designed to eject ink on an on demand basis and formed by using electrothermal transducers are employed for the inkjet devices 103 and 107. Such inkjet devices include a line head type inkjet head where a line head is arranged on a line that runs substantially in parallel with the shaft 106 of the intermediate transfer member 101. As described above, the reaction solution and inks are sequentially applied onto the outer peripheral surface of the intermediate transfer member 101 to form a first intermediate image and the auxiliary liquid is additionally applied to the first intermediate image. Then, a second intermediate image (a mirror image of the desired image) is formed by these liquid. Furthermore, an air blower 110 is arranged in order to reduce the liquid content in the second intermediate image on the intermediate transfer member 101. With this arrangement, the liquid content in the second intermediate image is reduced to suppress the disturbances to the image that can take place at the time of image transfer and hence an excellent image can be obtained.

The support member 102 of the intermediate transfer member 101 contains a heater (first temperature adjusting section) 112 in the inside thereof. The heater 112 is designed to heat the intermediate transfer member and raise its temperature to the melting point or higher of the wax particles contained in the auxiliary liquid before the second intermediate image is transferred as will be described hereinafter. The technique of heating the second intermediate image is not necessarily be limited to the use of a heater contained in the support member 102 as illustrated in FIG. 1 and an external heater such as an infrared heater may alternatively be employed. Additionally, while the second intermediate image is heated before it is transferred in FIG. 1, the second intermediate image may alternatively be heated during the transferring operation during which the second intermediate image is held in contact with the recording medium. A pressure roller 113 having an outer peripheral surface arranged vis-à-vis the outer peripheral surface of the intermediate transfer member 101 is arranged at a further downstream position as viewed in the sense of rotation of the intermediate transfer member 101. The transfer unit of the apparatus in FIG. 1 has an intermediate transfer member 101 and a pressure roller 113, which operate as a pair of rollers disposed face to face, and the pressure roller 113 operates as a transfer roller. The second intermediate image and the recording medium 108 that are laid one on the other on the intermediate transfer member 101 are inserted into the nip section formed by the intermediate transfer member 101 and the pressure roller 113 and the second intermediate image is brought into contact with the recording medium 108 under the pressure applied by the pressure roller so as to allow the second intermediate image to be transferred onto the recording medium 108.

The pressure roller 113 contains a cooling section (second temperature adjusting section) 115 in the inside thereof. The temperature at the time of image transfer can be lowered below the melting point Tm of the wax particles by the cooling section 115. As described above, in the apparatus illustrated in FIG. 1, an image transferring operation can efficiently be conducted as the second intermediate image on the intermediate transfer member 101 and the recording medium 108 are pinched between the intermediate transfer member 101 and the pressure roller 113 and pressurized. In other words, in the actual transfer step, the second intermediate image formed on the intermediate transfer member 101 is brought into contact with the recording medium 108 that is being conveyed along conveyance guide 109 by the rotation of the conveyance roller 114 in transfer region 131. Then, as the second intermediate image is peeled off from the intermediate transfer member 101, the second intermediate image is transferred onto the recording medium 108.

In the apparatus of this embodiment, the second intermediate image that is held in contact with the recording medium 108 is peeled off from the intermediate transfer member 101, while maintaining the contact between the recording medium 108 and the second intermediate image. At this time, a cooling operation of the cooling section 115 is utilized to adjust the temperature of the second intermediate image. However, the technique for adjusting the temperature of the second intermediate image at the time of peeling off the second intermediate image is not limited to the above-described one and the cooling effect based on the emission of heat from the second intermediate image within the transfer means may alternatively be utilized.

In such an instance, the type of the recording medium, the structure of the transfer region and the constituting material of the transfer region are desirably be so selected as to make the temperature history from the time when the second intermediate image whose temperature is adjusted to Tc (≤Tm) is supplied to the transfer region 131 to the time when the second intermediate image is peeled off from the intermediate transfer member 101 proves to be "Tc≥Tm>Tr". Additionally, in an instance where the second intermediate image is cooled by emission of heat and the recording medium 108 is supplied to the transfer unit at room temperature (e.g., 25° C.), the absorption of heat by the recording medium 108 takes a major role in reducing the temperature of the second intermediate image and adjusting the temperature to Tr. Thus, in the above-described instance, the first temperature adjusting section only heats the intermediate transfer member but this operation does not entail any problem so long as the requirement of "Tc≥Tm>Tr" is satisfied. Additionally, as the intermediate transfer member is heated by the heater 112, the second intermediate image on the intermediate transfer member is consequently heated so that there may be cases where the liquid content in the second intermediate image is removed. Therefore, in the above described instance, the target temperature of Tc is achieved as the surface temperature of the intermediate transfer member 101 where the second intermediate image is formed is raised by the heating operation of the heater 112 in the apparatus illustrated in FIG. 1. Additionally, the recording medium 108 is supplied to the pressure roller 113 at room temperature (25° C.). With these arrangements, the temperature of Tr is achieved by the emission of heat to the recording medium 108 that takes place as the second intermediate image contacts the recording medium 108 over a small area (the area of the region defined by the nip width).

The recording medium 108 may well be a sheet of printing paper, which paper may be coated paper, matte paper or the like. Furthermore, the recording medium 108 may be in the form of a sheet cut to show specified dimensions, in the form of a long sheet or in the form of a rolled sheet.

With the apparatus illustrated in FIG. 1, the first temperature of the intermediate transfer member 101 in the transfer region 131 is not lower than the melting point Tm of the wax particles in the second intermediate image. On the other hand, the temperature of the recording medium 108 is less than the melting point Tm of the wax particles. Then, as a result, when the second intermediate image is transferred in the transfer region 131, the strength of adhesion between the second intermediate image and the recording medium 108 is above the strength of adhesion between the second intermediate image and the intermediate transfer member 101, so that the second intermediate image is efficiently transferred onto the recording medium 108.

Figure 3:
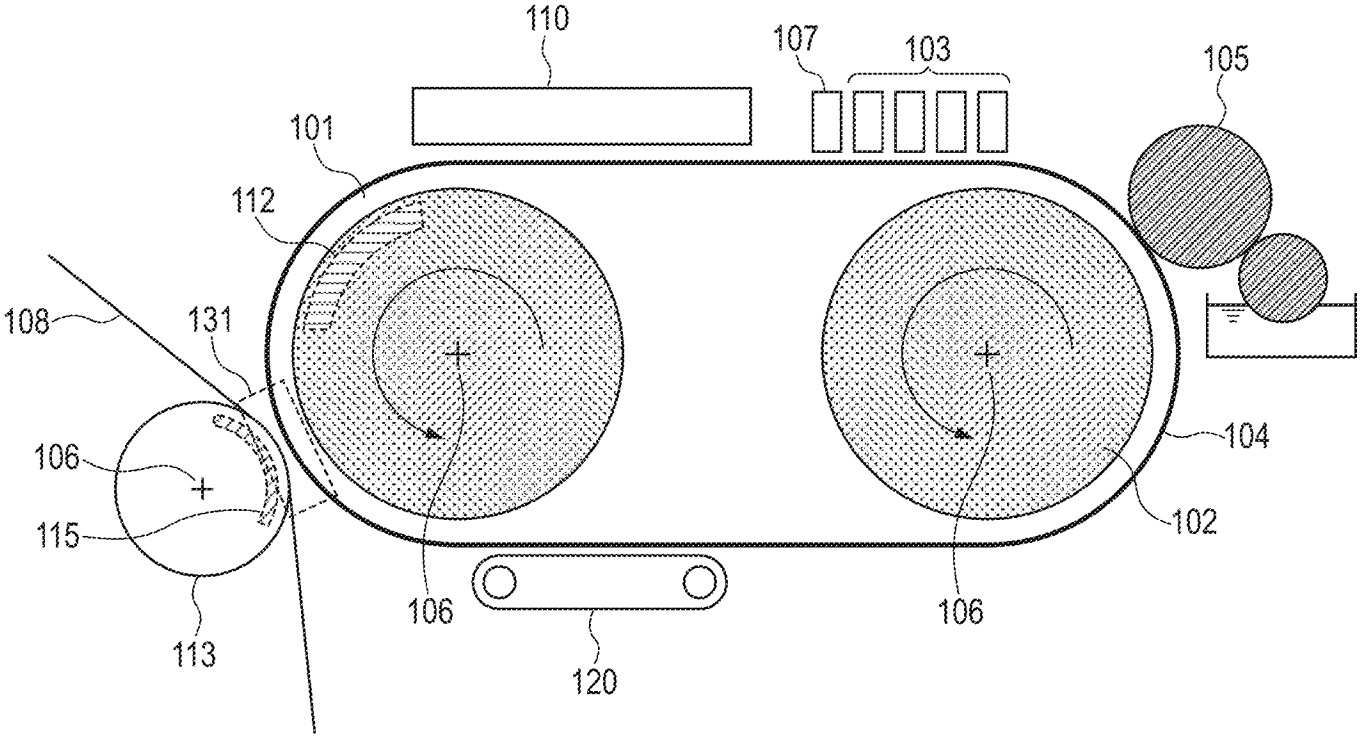
FIG. 3 is a schematic illustration of another embodiment of image recording apparatus according to one aspect of the present invention.

FIG. 3 is a schematic illustration of another embodiment of image recording apparatus according to the present invention. This embodiment differs from the embodiment of FIG. 1 in that the intermediate transfer member 101 is belt-shaped and a conveyer belt (or fixing belt) 120 is provided.

Figure 4:
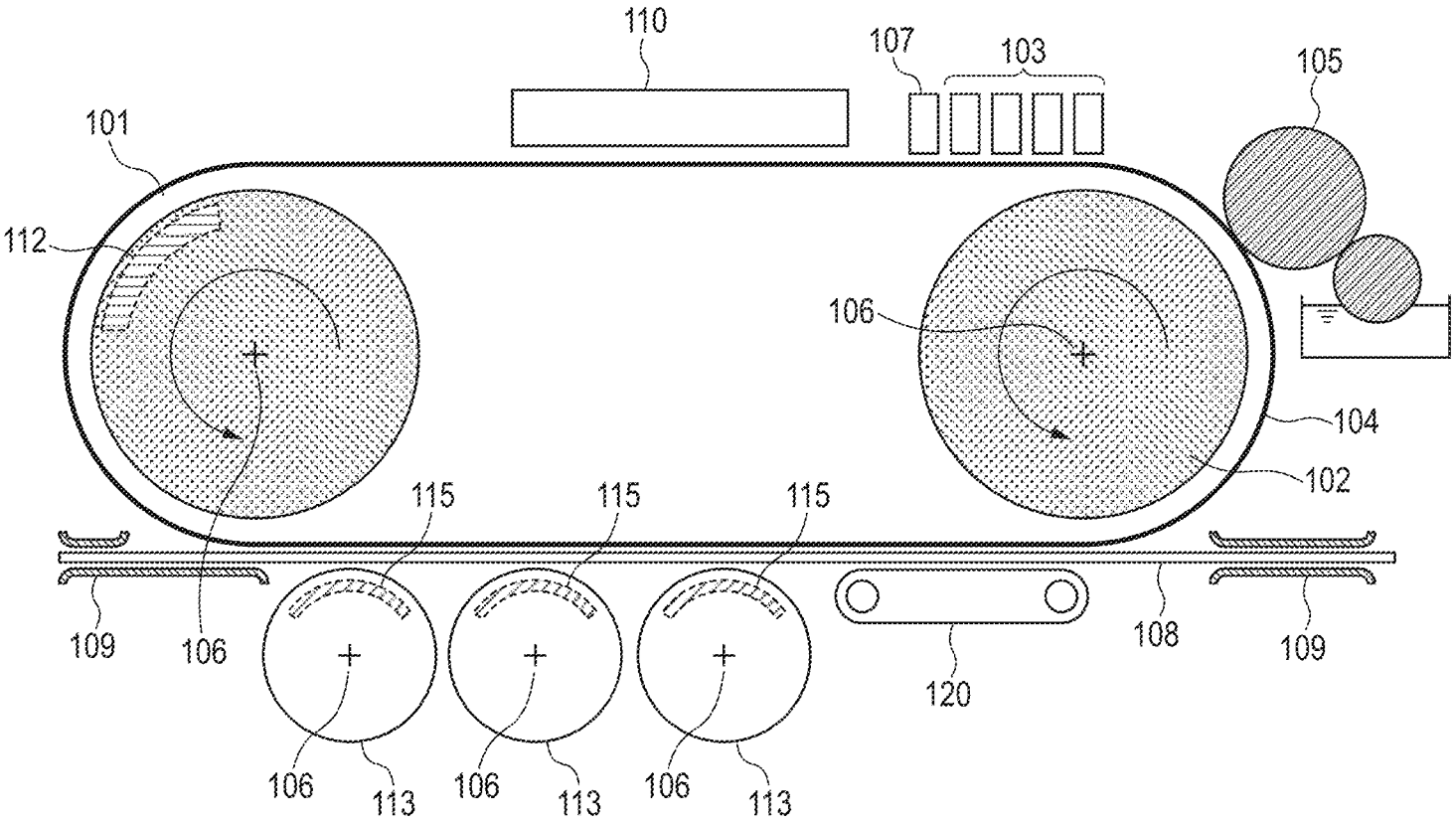
FIG. 4 is a schematic illustration of still another embodiment of image recording apparatus according to one aspect of the present invention.

FIG. 4 is a schematic illustration of still another embodiment of image recording apparatus according to the present invention. This embodiment differs from the embodiment of FIG. 1 in that the intermediate transfer member 101 is belt-shaped and a conveyor belt (or fixing belt) 120 is provided and that a plurality of pressure rollers 113 are also provided.

The intermediate transfer members 101 illustrated in each of FIGS. 3 and 4 are realized by altering the surface layer section 104 of the apparatus of FIG. 1 so as to make it take the shape of a belt that is extended between and wound around a pair of support members 102 and driven to move as the support members 102 are driven to rotate. When the belt 120 is utilized as fixing belt, the fixing step, which will be described hereinafter, can be executed by using this fixing belt.

The arrangement of each of the image recording apparatus of FIGS. 3 and 4 other than the above-described components is similar to that of the image recording apparatus of FIG. 1 and hence will not be described any further.

As for Tc and Tr, they are not subjected to any particular limitations so long as the requirement of "Tc≥Tm>Tr" is satisfied, although Tc is preferably not lower than 50° C. and not higher than 140° C. Tr is preferably not lower than 25° C. and not higher than 90° C.

Now, the individual constituent sections of this embodiment of image recording apparatus will be described in detail below.

<Intermediate Transfer Member>

The intermediate transfer member operates as a base member for holding a reaction solution, inks and an auxiliary liquid in order to form intermediate images. The intermediate transfer member includes a support member for handling the intermediate transfer member and transmitting necessary power and a surface layer member arranged on the support member to form an intermediate image thereon. Each of the support member and the surface layer member may be a uniform and unique member or may be formed by using a plurality of independent component members.

The support member may take the shape of a sheet, a roller, a drum, a belt, an endless web, etc. Note that, when a drum-shaped support member or a belt-shaped support member having an endless web-like configuration is employed, the same intermediate transfer member can repeatedly be operated for use to provide a remarkable advantage from the viewpoint of productivity. The size of the intermediate transfer member can freely be selected so as to make it match the sizes of the images to be printed by the apparatus. The support member of the intermediate transfer member is required to show a certain degree of structural strength from the viewpoint of conveyance accuracy and durability. As for the material of the support member, the use of metal, ceramic, resin or the like is suitable. Particularly, from the viewpoint of characteristics required to the support member for reducing the inertia in operation to improve the control responsiveness in addition to the rigidity and the dimensional accuracy required to withstand the pressure applied to it at the time of transferring operations, materials that can suitably be used for the support member include aluminum, iron, stainless steel, acetal resin, epoxy resin, polyimide, polyethylene, polyethylene terephthalate, nylon, polyurethane, silica ceramics and alumina ceramics.

Any of these materials may preferably be used in combination. Furthermore, when the apparatus illustrated in FIG. 1 is employed, a support member 102 that can provide the temperature history as described earlier for intermediate images may preferably be selected.

The surface layer member of the intermediate transfer member preferably has a certain degree of elasticity from the viewpoint of causing a second intermediate image to adhere to a recording medium which may typically be paper under pressure in order to facilitate the operation of transferring the second intermediate image onto the recording medium. When paper is used for the recording medium, the hardness of the surface layer member of the intermediate transfer member is preferably not less than 10° and not more than 100°, more preferably not less than 20° and not more than 60°, in terms of durometer type A (conforming to JIS•K6253) hardness. The material of the surface layer member may appropriately be selected from various materials including polymers, ceramics and metals, although the use of a rubber material selected from various rubber materials or an elastomer material selected from various elastomer materials is preferable from the viewpoint of the characteristics and the processing characteristics thereof.

Examples of preferable materials that can be used for the surface layer member include polybutadiene-based rubber, nitrile-based rubber, chloroprene-based rubber, silicone-based rubber, fluorine-based rubber, urethane-based rubber, styrene-based elastomer, olefin-based elastomer, vinyl chloride-based elastomer, ester-based elastomer and amide-based elastomer. The use of, e.g., polyether, polyester, polystyrene, polycarbonate, siloxane compound, perfluorocarbon compound is also preferable. In particular, the use of nitrile butadiene rubber, silicone rubber, fluorine rubber or urethane rubber is preferable from the viewpoint of dimensional stability, durability, thermal resistance and so on.

Additionally, a surface layer member formed by laminating a plurality of materials can suitably be used for the purpose of the present invention. Such a laminate surface layer member may suitably be formed, for example, by coating an urethane rubber-made endless belt with silicone rubber, by laying silicone rubber on a sheet of PET film or by producing a laminated material prepared by forming film of a polysiloxane compound on a sheet of urethane rubber. Furthermore, a sheet produced by using woven cotton fabric, woven polyester fabric or woven rayon fabric as base fabric and impregnating the base fabric with a rubber material such as nitrile butadiene rubber or urethane rubber may also suitably be used. The surface layer member may be subjected to an appropriate surface treatment for use. Examples of such surface treatment include flame treatment, corona treatment, plasma treatment, polishing treatment, roughening treatment, active energy ray (UV, IR, RF, etc.) irradiation treatment, ozone treatment, surfactant treatment and silane coupling treatment. A plurality of materials selected from the above-listed materials may suitably be used in combination. An adhesive agent or a double-sided tape may be used between the surface layer member and the support member in order to stably hold them in position.

<Reaction Solution>

The reaction solution contains an ink viscosity increasing component. The expression of "ink viscosity increasing" is a phenomenon including at least one of (i) and (ii) shown below.

(i) a phenomenon where the coloring material and/or the resin that is a part of the ink ingredients chemically reacts with or physically adsorbs the ink viscosity increasing component as they contact with each other to thereby raise the overall viscosity.

(ii) a phenomenon where a part of the ingredients of the ink including the coloring material agglomerates to locally raise the viscosity.

The ink viscosity increasing component provides the effect of reducing the fluidity of the ink or a part of the ink on the intermediate transfer member to suppress bleeding and beading during image forming operations. The concentration of the ink viscosity increasing component in the reaction solution may appropriately be selected according to the type of the ink viscosity increasing component, the conditions under which the reaction solution is applied to the intermediate transfer member, the type of the ink and so on. For this embodiment, any known ink viscosity increasing component such as polyvalent metal ions, an organic acid, a cationic polymer or porous particles may appropriately be selected and used without any particular limitations. Of the above-listed ones, polyvalent metal ions or an organic acid may especially suitably be used. Additionally, the reaction solution may suitably be made to contain a plurality of different types of ink viscosity increasing components. Note that the content ratio of the ink viscosity increasing component(s) in the reaction solution is preferably not less than 5 mass % relative to the total mass of the reaction solution.

More specifically, metal ions that can be used as ink viscosity increasing component are divalent metal ions and trivalent metal ions.

Examples of the divalent metal ion include $Ca^{2+}$, $Cu^{2+}$, $Ni^{2+}$, $Mg^{2+}$, $Sr^{2+}$, $Ba^{2+}$ and $Zn^{2+}$. Examples of the trivalent metal ion include $Fe^{3+}$, $Cr^{3+}$, $Y^{3+}$ and $Al^{3+}$. Specific examples of the organic acids that can be used as ink viscosity increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, dioxy succinic acid.

The reaction solution can be made to contain a single viscosity increasing component or two or more than two viscosity increasing components in combination.

The reaction solution may contain water and an organic solvent by an appropriate content ratio. Water to be contained in the reaction solution is preferably water that is deionized typically by means of ion exchange or the like. Organic solvents that can be used for the reaction solution are not subjected to any particular limitations. In other words, any known organic solvents can be used for the reaction solution. Any of various resins may be added to the reaction solution. This is because when resin is added to the reaction solution, it can suitably improve the adhesion of the second intermediate image to the recording medium at the time of transferring the second intermediate image and raise the mechanical strength of the obtained final image. Resins that can be used for the reaction solution are not subjected to any particular limitations so long as such resins can coexist with the ink viscosity increasing component. A surfactant and/or a viscosity modifier may be added to the reaction solution to appropriately adjust the surface tension and the viscosity of the reaction solution. Materials to be used for the surfactant and the viscosity modifier are not subjected to any particular limitations so long as they can coexist with the ink viscosity increasing component. Specific examples of the surfactants include ACETYLENOL E100 (product name, manufactured by KAWAKEN FINE CHEMICALS Co., Ltd.).

Now, the ingredients that can be used for an ink of this embodiment will be described below.

(a) Coloring Material

For this embodiment, ink can contain at least one of a pigment and a dye. Pigments and dyes that can be used for this embodiment are not subjected to any particular limitations and any coloring material that can be used for inks may appropriately be selected and used so as to show a required content ratio. For example, dyes, carbon black and organic pigments that are known as materials that can be used for inks for inkjet printing may appropriately be selected and used for this embodiment. Coloring materials prepared by dissolving and/or dispersing a dye and/or a pigment may suitably be used for this embodiment. Of such coloring materials, various pigments are characterized by the durability and the grade they can provide when used for printed matters and hence they can also suitably be used for this embodiment. The content ratio of the coloring material in the ink may appropriately be selected within an appropriate range for forming the target first intermediate image. In other words, the content ratio is not subjected to any particular limitations.

(b) Pigment

There are no particular limitations to pigments to be used for inks for this embodiment and any known inorganic pigments and organic pigments may be used. Specific examples of the pigments include those indicated by C.I. (color index) numbers. The use of carbon black is preferable as black pigment. The content ratio of the pigment in the ink is preferably not less than 0.5 mass % and not more than 15.0 mass %, more preferably not less than 1.0 mass % and not more than 10.0 mass % relative to the total mass of the ink.

(c) Pigment Dispersant

Any known pigment dispersants to be used with inkjet technology can also be used to disperse pigments. Of such pigment dispersants, the use of water-soluble pigment dispersants having both a hydrophilic part and a hydrophobic part in the molecular structure is preferable. In particular, the use of pigment dispersants made of resin formed by copolymerizing hydrophilic monomers and hydrophobic monomers is highly preferable. The monomers are not subjected to any particular limitations and any known appropriate monomers can be used. Specific examples of the hydrophobic monomers include styrene, styrene derivatives, alkyl (meth)acrylate, benzyl(meth)acrylate. Specific examples of the hydrophilic monomers include acrylic acid, methacrylic acid and maleic acid.

The acid value of the pigment dispersant is preferably not less than 50 mgKOH/g and not more than 550 mgKOH/g. The weight average molecular weight of the pigment dispersant is preferably not less than 1,000 and not more than 5,000. Additionally, the mass ratio of the pigment to the pigment dispersant is preferably within the range between 1:0.1 and 1:3.

So-called self-dispersing pigments formed by modifying the pigment surface so as to make the pigment dispersible can suitable be used. Then, the use of a pigment dispersant for the ink will become unnecessary.

(d) Resin Particle

Inks may be made to contain various resin particles that do not have any coloring material in them. Some of such resin particles are effective for improving the image grade and the fixing property and hence can suitable be used. Materials of the resin particles are not subjected to any particular limitations and any known resin materials may be used. Specific examples of the resin materials include homopolymers such as polyolefin, polystyrene, polyurethane, polyester, polyether, polyurea, polyamide, polyvinyl alcohol, poly (meth)acrylic acid and salts thereof, polyalkyl (meth)acrylate and polydiene as well as copolymers formed by combining two or more than two of such homopolymers. The weight average molecular weight of the resin of resin particles is preferably not less than 1,000 and not more than 2,000,000. The content ratio of the resin particles in the ink is preferably not less than 1 mass % and not more than 50 mass %, more preferably not less than 2 mass % and not more than 40 mass %.

From the viewpoint of exploiting the effects of using the resin particles, the glass transition temperature Tg of the resin particles is preferably not lower than 30° C. and not higher than 150° C.

Additionally, for this embodiment, the resin particles are preferably added to the inks after causing them to take the form of a resin particle dispersion obtained by dispersing the resin particles in solvent. Techniques to be used to disperse the resin particles in solvent are not subjected to any particular limitations, although the use of a so-called self-dispersed resin particle dispersion obtained by causing the resin formed by homopolymerization of a monomer having dissociable groups or by copolymerization of several such monomers is preferable. Examples of the dissociable groups include carboxyl groups, sulfonic acid groups and phosphoric acid groups. Examples of the monomers having dissociables group include acrylic acid and methacrylic acid.

Additionally, emulsified and dispersed type resin particle dispersions obtained by dispersing resin particles by means of an emulsifier can also suitably be used for this embodiment. Known surfactants can suitably be used as emulsifiers for this embodiment regardless if the surfactant is a low molecular weight surfactant or a high molecular weight surfactant. Preferably, the surfactant is non-ionic or has an electric charge of the polarity same as that of the resin particles. The resin particle dispersion desirably has a dispersion particle size of not less than 10 nm and not more than 1,000 nm; more preferably, not less than 100 nm and not more than 500 nm. When preparing a resin particle dispersion to be used for this embodiment, any of various additives are preferably added thereto in order to stabilize the dispersion. Examples of the additives include n-hexadecane, dodecyl methacrylate, stearyl methacrylate, chlorobenzene, dodecyl mercaptan, olive oil, blue dye (bluing agent; Blue 70) and polymethyl methacrylate.

(e) Surfactant

The ink may contain a surfactant. Specific examples of the surfactant include ACETYLENOL E100 (product name, manufactured by KAWAKEN FINE CHEMICALS Co., Ltd.). The content ratio of the surfactant in the ink is preferably not less than 0.01 mass % and not more than 5.0 mass % relative to the total mass of the ink.

(f) Water and Water-Soluble Organic Solvent

Aqueous liquid mediums containing water or a mixture of water and a water-soluble organic solvent can be used as liquid medium for ink. An aqueous ink can be obtained by adding at least one of a dye and a pigment to an aqueous liquid medium.

Water to be used to form ink is preferably deionized water obtained by means of ion exchange or the like. The water content ratio in the ink is preferably not less than 30 mass % and not more than 97 mass % relative to the total mass of the ink.

The type of a water-soluble organic solvent is not subjected to any particular limitations and any known organic solvents can be used. Specific examples of organic water-soluble organic solvents include glycerin, diethylene glycol, polyethylene glycol and 2-pyrrolidone. The content ratio of the water-soluble organic solvent in the ink is preferably not less than 3 mass % and not more than 70 mass % relative to the total mass of the ink.

(g) Other Additives

If necessary, the ink can be made to contain a pH control agent, an anti-rust agent, an antiseptic, an anti-mold agent, an antioxidant, an anti-reducing agent, a water-soluble resin material and a neutralizer thereof, a viscosity modifier and/or one or more than one other additives.

<Auxiliary Liquid>

An auxiliary liquid that is a transfer assisting liquid containing wax particles and a water-soluble resin, which operates as a binder in the second intermediate image, is applied onto the intermediate transfer member. Then, as a result, the adhesion of the second intermediate image to the recording medium is improved so that the scratch resistance (fixing property) of the final image obtained after transferring the second intermediate image onto the recording medium can be improved. The auxiliary liquid may be either aqueous or non-aqueous, although the auxiliary liquid contains a water-soluble resin and wax particles.

In the present invention, a water-soluble resin refers to a resin that can be dissolved into water. The type of the water-soluble resin in the auxiliary liquid is not subjected to any particular limitations so long as it exerts the required binder function in the second intermediate image, although preferably the type of the water-soluble resin is selected according to the type of the auxiliary liquid application means. For example, if the auxiliary liquid application means is an inkjet device, the water-soluble resin has a weight average molecular weight that is preferably not less than 2,000 and not more than 20,000, more preferably not less than 5,000 and not more than 10,000. If the auxiliary liquid application means is a roller type application means, a water-soluble resin having a greater weight average molecular weight than the above range can be used.

Both a glass transition temperature (glass transition point: Tg) of the water-soluble resin and a melting point (Tm) of the wax particles in the auxiliary liquid are preferably not lower than 40° C. and not higher than 150° C.

Specific examples of such water-soluble resin include block copolymers, random copolymers, graft copolymers and their salts formed from two or more than two monomers (of which at least one is a hydrophilic polymerizable monomer) selected from styrene, styrene derivatives, vinyl naphthalene, vinyl naphthalene derivatives, aliphatic alcohol esters of α,β-ethylenically unsaturated carboxylic acid, acrylic acid, acrylic acid derivatives, maleic acid, maleic acid derivatives, itaconic acid, itaconic acid derivatives, fumaric acid and fumaric acid derivatives as well as vinyl acetate, vinyl alcohol, vinyl pyrrolidone, acrylamide and their derivatives. Additionally, natural resins such as rosin, shellac and starch can also preferably be used. The above-listed water-soluble resins are alkali-soluble type resins that can be dissolved into aqueous solution obtained by dissolving a base into water. Particularly, the water-soluble resin has a hydrophobic part in it. While the hydrophobic part is not subjected to any particular limitations, the hydrophobic part preferably has a functional group having an unsaturated bond such as a styrene group.

One of these water-soluble resins or a combination of two or more than two of these water-soluble resins can be used as an ingredient of the auxiliary liquid.

In the present invention, wax particles refer to an organic compound that is solid at room temperature and has a melting point.

The wax component contained in wax particles may be, for example, a natural wax or a synthetic wax.

Examples of a natural wax include a petroleum wax, a plant wax and an animal wax.

Examples of the petroleum wax include a paraffin wax, a microcrystalline wax and a petrolatum. Examples of the plant wax include a carnauba wax, a candelilla wax, a rice wax and a Japan wax. Examples of the animal wax include a lanolin and a bees wax.

Examples of the synthetic wax include a synthetic hydrocarbon-based wax and a modified wax.

Examples of the synthetic hydrocarbon-based wax include a polyethylene wax and a fischer tropsch wax. Examples of the modified wax include a paraffin wax derivatives, a montan wax derivatives and a microcrystalline wax derivatives. Any one of these may be used alone or two or more than two of them may be used in combination.

The wax particles are preferably used in the form of wax particle dispersion, in which the wax particles are dispersed in liquid, to prepare the auxiliary liquid. The wax particles are preferably formed by dispersing a wax component by means of a dispersant. The dispersant is not subjected to any particular limitations and, for examples, any known dispersant may appropriately be used. The type of dispersant is preferably selected by taking the stability of the wax particles in the auxiliary liquid into consideration. The water-soluble resin that operates as a binder component as described above can also be used as a dispersant for dispersing the wax particles.

From the viewpoint of improving the transfer efficiency, the volume average particle diameter of the wax particles in the auxiliary liquid is preferably not greater than 10 nm to 1,000 nm, more preferably not greater than 50 nm to 500 nm. When the volume average particle diameter of the wax particles in the auxiliary liquid is within the above-defined range, the wax particles can be held on the ink agglomeration layer much easier. Then, as a result, it may be safe to assume that a greater number of the wax particles fill the gaps along the interface between the recording medium and the ink receiving layer in transferring to in turn further improve the transfer efficiency.

The content ratio of the water soluble resin in the auxiliary liquid is preferably not less than 0.1 mass % and not more than 20 mass %, more preferably not less than 0.1 mass % and not more than 10 mass %, further preferably not less than 0.1 mass % and not more than 5 mass % relative to the total mass of the auxiliary liquid. So long as the content ratio of the water soluble resin is held within the above-specified range, the ejection stability, the landing position accuracy of ejected droplets and other characteristics of auxiliary liquid ejections will be improved when the auxiliary liquid is ejected from an inkjet device and also the application uniformity will be improved when the auxiliary liquid is applied by means of a roller.

The content ratio of the wax particles in the auxiliary liquid is preferably not less than 0.5 mass % and not more than 20 mass %, more preferably not less than 1 mass % and not more than 10 mass %, relative to the total mass of the auxiliary liquid. The mass ratio of the water soluble resin to the wax particles (the content amount of the water soluble resin: the content amount of the wax particles) in the auxiliary liquid is selected preferably from the range between 3:1 and 1:10, more preferably from the range between 1:1 and 1:10.

Additionally, the auxiliary liquid preferably contains resin particles. Any of resin particles to be used in the ink described earlier can be selected as resin particles to be used in the auxiliary liquid. As the auxiliary liquid is made to contain the resin particles, any unnecessary move of the second intermediate image formed by the ink applied to the intermediate transfer member can be suppressed and the toughness of the image on the recording medium can be improved. Additionally, when the resin particles are added, the strength of the auxiliary liquid layer is raised to in turn improve the image transfer performance.

The mass ratio of the resin particles to the wax particles (the content amount of the resin particles:the content amount of the wax particles) in the auxiliary liquid is selected preferably from the range between 10:1 and 1:20, more preferably from the range between 5:1 and 1:10. When the mass ratio of the resin particles to the wax particles is selected from the above-defined range, the resin particles can be made to operate more effectively.

The surface tension of the auxiliary liquid is preferably lower than the surface tension of the ink. Then, as a result, the auxiliary liquid spreads on the intermediate transfer member to improve the accessibility of the auxiliary liquid to the ink. Besides, the glass transition temperature Tg of the resin particles is preferably not less than 30° C. and not higher than 150° C.

In addition to the above-described ingredients, the auxiliary liquid may be made to contain various additives that can be used for inks such as a surfactant, a water-soluble organic solvent modifier, an anti-rust agent, an antiseptic, an anti-mold agent, an antioxidant, an anti-reducing agent, a water-soluble resin and a neutralizer thereof and/or a viscosity modifier.

When the auxiliary liquid is non-aqueous, any organic solvent selected from known organic solvents can be used as organic solvent for the auxiliary liquid, although the use of an alcohol type organic solvent such as methanol or ethanol is preferable.

A liquid set to be used for transfer type image recording operations can be prepared by using the ink and the auxiliary liquid as described earlier. If necessary, such a liquid set can be made to additionally include the reaction solution as described earlier.

The liquid set can suitably be used for an image recording method as will be described hereinafter, in other words, for a transfer type image forming.

In a case where the materials for forming the second intermediate image contain an anionic group, when the ink and/or the auxiliary liquid is to be agglomerated on the intermediate transfer member, a compound that forms a hydrogen bond with the anionic group is preferably added to the ink and/or the auxiliary liquid from the viewpoint of achieving high-speed agglomeration. Examples of the materials containing an anionic group include those prepared by introducing an anionic group such as a carboxylic group in order to impart solubility or dispersibility into the water-soluble resin and/or the resin particles.

When the auxiliary liquid gets into an agglomerated state, the problem of positional displacement of image at the time of transferring can effectively be prevented from taking place even when the second intermediate image is dried only insufficiently. Furthermore, the binding force among the agglomerates in the second intermediate image is raised to make the transferring much easier. Specific examples of additives to be used for this purpose include block copolymers of ethylene oxide structure and propylene oxide structure, and compounds having a block copolymer part of ethylene oxide structure and propylene oxide structure. Any one of the above-described additives can be used alone but two or more than two of them can also be used in combination.

More specifically, surfactants expressed by general formula (1) and (2) shown below are block copolymers of ethylene oxide structure and propylene oxide structure.

general formula (1)

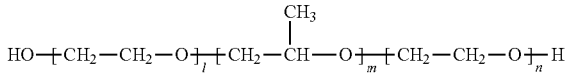

In the general formula (1), l+n is not smaller than 3 and not greater than 45 and m is not smaller than 16 and not greater than 57.

general formula (2)

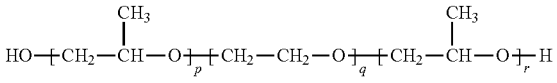

In the general formula (2), p+r is not smaller than 25 and not greater than 50 and q is not smaller than 8 and not greater than 25. Note that l through r can independently take respective values, each of which may be an integer or a real number, within the above-identified respective ranges. Additionally, the use of a surfactant expressed by the general formula (1) is more preferable and furthermore, in the general formula (1), particularly preferably l+n is not smaller than 3 and not greater than 15 and m is not smaller than 16 and not greater than 31. The ink and/or the auxiliary liquid can be made to contain at least a surfactant selected from compounds that are expressed by the general formula (1) and those that are expressed by the general formula (2). The content ratio (mass %) of the at least a surfactant is preferably not less than 0.2 mass % and not more than 5 mass %, more preferably not less than 1 mass % and not more than 4 mass %, relative to the total mass of the ink or the auxiliary liquid.

When the ink and/or the auxiliary liquid contains the resin particles, the compounding ratio of the resin particles in the ink and/or the auxiliary liquid relative to the at least a surfactant is preferably not less than 1 time and not more than 10 times, more preferably not less than 1.5 times and not more than 5.0 times, in terms of mass ratio.

Note that the compounding ratio of the resin particles relative to the surfactant can be determined by the formula shown below.

Compounding ratio of resin particles relative to a surfactant=[content amount of resin particles]/[content amount of at least a surfactant selected from compounds expressed by general formula (1) and (2)]

Examples of compounds that function as surfactants include L-31, L-34, L-61, P-84, P-103, L-101 and P-85 manufactured by ADEKA CORPORATION.

A polyvalent alcohol compound having a polyalkyleneoxy structure can also be utilized as a compound that can form a hydrogen bond with an anionic group. Such a polyvalent alcohol compound having a polyalkyleneoxy chain can be synthetically produced by using a polyvalent alcohol compound as initiator and adding an alkyleneoxy group thereto. Such a polyvalent alcohol compound having a polyalkyleneoxy chain has a structure obtained by substituting the hydrogen atom in the hydroxyl group that the polyvalent alcohol, which operates as initiator, has with a structure expressed by -Rs-H. R in -Rs-H represents an alkyleneoxy group. When s is not less than 2 and R is two or more than two, each R independently represents an alkyleneoxy group.

Preferably, the polyvalent alcohol that can be utilized as the initiator has three or more than three carbon atoms and, at the same time, three or more than three hydroxyl groups (in other words trivalent or higher).

Specific examples of the polyvalent alcohols that can be utilized as the initiator include sorbitol, maltitol, xylitol, erythritol, lactitol, mannitol, glycerin, diglycerin, polyglycerin, oligosaccharide alcohol, palatinit (isomalt), threitol, arabinitol, ribitol, iditol, volemitol, perseitol, octitol, galactitol, trimethylolpropane, trimethylolethane, dimethylolheptane, glucose, glucoside and condensates of any of the above-listed polyvalent alcohols. Examples of condensates of polyvalent alcohols include dipentaerythritol. Of the above-listed polyvalent alcohols, preferable ones are sorbitol, xylitol, erythritol, dipentaerythritol, mannitol, glycerin, diglycerin, polyglycerin and trimethylolethane.

Preferably, the number of R per molecule in the polyvalent alcohol compound having a polyalkyleneoxy chain is not less than 40 and not more than 120 when the valence number of polyvalent alcohol is 3, and not less than 12 and not more than 400 when the valence number of polyvalent alcohol is 4 or greater than 4. Furthermore, preferably, the number of R per molecule is not less than 50 and not more than 120 when the valence number of polyvalent alcohol is 4, and not less than 40 and not more than 400 when the valence number is not less than 5 and not more than 12. Note that "the number of R per molecule" means the total number of repeat units of alkyleneoxy groups contained in a polyvalent alcohol compound having a polyalkyleneoxy chain.

Examples of the alkyleneoxy groups that function as R in the structure expressed by -Rs-H include straight chain alkylene groups having 1 to 3 carbon atoms such as an ethyleneoxy group, a methyleneoxy group and a propyleneoxy group.

The substituent expressed by -Rs-H is preferably a polyalkyleneoxy group that includes a polyethyleneoxy structure of $[—(CH_2CH_2O)_x—]$.

R may be a combination of a plurality of different alkyleneoxy groups. For example, a structure that contains both ethyleneoxy groups and propyleneoxy groups and the sum of the total repeat number of the former groups and the total repeat number of the latter groups is equal to s is included in structures expressed by -Rs-H. A structure that is expressed by -Rs-H may be a random copolymer or a block copolymer of ethyleneoxy groups and some other alkyleneoxy groups. If such is the case, the ratio of the ethyleneoxy groups is preferably not less than 5 mass % of the entire structure expressed by -Rs-H, from the view point of water solubility.

Polyvalent alcohol compounds having polyalkyleneoxy groups are preferably block copolymers of ethyleneoxy groups and propyleneoxy groups. For example, a structure expressed by $[—(CH_2CH_2O)_x—(CHCH_3CH_2O)_y—H]$ or by $[—(CHCH_3CH_2O)_y—(CH_2CH_2O)_x—H]$ is preferable from the viewpoint of the interaction of a coloring material and resin particles. Additionally, polyvinyl alcohol, polyvinyl alcohol copolymers, polyvinylpyrrolidone and polyvinyl pyrrolidone copolymers can also be utilized as compounds to form a hydrogen bond with an anionic group such as a carboxylic group.

Any one of the above-listed various additives may be used alone, or combination of two or more than two of the additives may be used for the purpose of the present invention.

(Image Recording Method)

With this embodiment of image recording method, after applying the reaction solution onto the intermediate transfer member, preferably, the ink is applied onto the reaction solution on the intermediate transfer member to form a first intermediate image on the intermediate transfer member. Then, the auxiliary liquid is applied onto the first intermediate image on the intermediate transfer member to form a second intermediate image. Thereafter, the temperature of the second intermediate image is raised to a temperature Tc, which is not lower than a melting point Tm of the added wax particles, and a recording medium is brought into contact with the second intermediate image. Then, the temperature of the second intermediate image is brought to a temperature Tr, which lower than the melting point Tm of the wax particles, while maintaining the state where the second intermediate image is held in contact with the recording medium, and the second intermediate image is peeled off from the intermediate transfer member and transferred onto the recording medium. The above-described operations of temperature adjustment can be carried out by heating the intermediate transfer member that bears the second intermediate image thereon to a first temperature that is not lower than Tm, bringing the intermediate transfer member into contact with the recording medium, subsequently adjusting and lowering the temperature of the recording medium to a second temperature that is lower than the temperature Tm and finally conducting an operation of separating the recording medium from the intermediate transfer member.

Thus, at the time when the heated second intermediate image is brought into contact with the recording medium, the fluidity of the wax component in the second intermediate image is raised to intensify the tight adhesion between the recording medium and the second intermediate image. At this time, since the second intermediate image contains the wax particles and at the same time the water-soluble resin, the water-soluble resin is also fluidized to follow the flow of the wax component and becomes to be tightly held in contact with the recording medium so as to further intensify the tight adhesion. Additionally, at the time when the second intermediate image is transferred, the temperature of the second intermediate image rapidly falls to produce a temperature condition of Tr<Tm after to be contacted with the recording medium due to the cooling effect of the recording medium, so that the wax component gets into a solid state so that the second intermediate image can hardly be separated from the recording medium along the interface thereof. As a result, the efficiency of transferring of the second intermediate image onto the recording medium is improved to enable to stably produce a high quality image on the recording medium.

Note that, when the temperature of the intermediate transfer member is made to be equal to the first temperature, a certain time period is required for heat conduction from the intermediate transfer member to the second intermediate image to take place so as to make the temperature of the second intermediate image become equal to the first temperature. With this embodiment, however, the temperature of the second intermediate image can be made to be equal to Tc when the recording medium and the second intermediate image are brought into contact with each other because the intermediate transfer member is heated before the image transferring operation. Additionally, since the second intermediate image is produced as very thin film, if the second intermediate image is brought into contact with the recording medium whose temperature is equal to the second temperature in a state where the second intermediate image is not heated from the intermediate transfer member, heat conduction takes place from the second intermediate image to the recording medium in a very short period of time. At this time, the temperature of the recording medium is not raised and hence it is safe to assume that the temperature Tr of the second intermediate image becomes lower than the melting point Tm of the wax particles when the second intermediate image is peeled off from the intermediate transfer member. With the above-described mechanism, the temperature of the second intermediate image can be made to be equal to Tr at the time of transferring operation (at the time when the second intermediate image is peeled off from the intermediate transfer member). Thus, with this embodiment, since the second intermediate image is very thin, it is safe to assume that the rate of temperature change of the second intermediate image is not determined by the heat conduction rate in the second intermediate image. Therefore, it is not necessary to worry about a situation where the thermal conduction from the intermediate transfer member to the second intermediate image and the thermal conduction from the second intermediate image to the recording medium are time consuming to consequently give rise to a temperature gradient in the second intermediate image at the time of transferring.

"The first temperature" of this embodiment refers to the highest temperature of the intermediate transfer member during the period from the time when the second intermediate image is brought into contact with the recording medium to the time when the second intermediate image is peeled off from the intermediate transfer member. "The second temperature" of this embodiment refers to the temperature of the recording medium at the time when the second intermediate image is transferred (at the time when the second intermediate image is peeled off from the intermediate transfer member while maintaining the contact of the second intermediate image with the recording medium).

Both the first temperature and the second temperature can be confirmed, for example, by measuring the surface temperature of the intermediate transfer member and that of the recording medium before and after the transferring. Additionally, the temperature adjustment operations can be conducted by seeing the temperatures that are confirmed in the above-described manner. With the apparatus illustrated in FIG. 1, the temperature adjustment operations can be conducted according to a measuring result of the temperature of the intermediate transfer member before the nip section is produced by the intermediate transfer member and the pressure roller 131 and the surface temperature of the recording medium after the recording medium is forced to pass through the nip section.

The temperature adjustment operation of the second intermediate image can be conducted by means of the technique described below.

The temperature change on the surface of the intermediate transfer member from the time when the heater 112 starts a heating operation in the apparatus of FIG. 1 to the time when the pressure roller 113 starts a pressure applying operation, in other words during the conveyance operation of conveying the second intermediate image until it gets to the entrance of the nip section will be estimated in advance by using theoretical values and also by seeing the results of preliminary experiments. Additionally, the temperature change on the surface of the intermediate transfer member and the temperature change on the surface of the recording medium in the state where pressure is applied by the pressure roller 113 onto the surface of the intermediate transfer member by way of the recording medium 108 will be estimated in advance again by using theoretical values and also by seeing the results of preliminary experiments. The configuration and the operating conditions of the apparatus of FIG. 1 are selected and determined so as to make the temperature history based on the estimated values of the temperature changes suitable for achieving the targeted first and second temperatures.

Note that the temperature Tc and the temperature Tr of the second intermediate image can also be confirmed by observing the surface temperature of the second intermediate image before and after the pressure application by the pressure roller through the use of an infrared radiation thermometer. Tc and Tr can also be achieved by appropriately selecting and determining the configuration and the operating conditions of the apparatus of FIG. 1 on the basis of the temperatures that are confirmed in the above-described manner.

The difference between Tc and Tr (i.e., "Tc−Tr") is preferably not less than 5° C. and more preferably not less than 10° C.

Now, each of the steps of the image recording method of this embodiment will be described in detail below.

<Step of Reaction Solution Application>

An appropriate technique can be selected from various known techniques for applying a reaction solution to the image forming surface of an intermediate transfer member. Examples of such techniques include die coating, blade coating, techniques of using a gravure roller, techniques of using an offset roller and spray coating. Additionally, a technique of applying the reaction solution by means of an inkjet device can also suitably be used. Furthermore, a plurality of techniques selected from the above-listed ones can also suitably be used.

<Step of Ink Application>

Subsequently, an ink is applied to the image forming surface of the intermediate transfer member on which the reaction solution has already been applied to form a first intermediate image. While the technique to be used for the ink application is not subjected to any particular limitations, the ink is preferably applied by means of an inkjet device.

Exemplar modes of operation of the inkjet device that can be used for this embodiment include the following ones.

- a mode where film boiling is caused to take place in the ink by means of an electrothermal transducer to form bubbles for ejecting ink
- a mode where the ink is ejected by means of an electromechanical transducer
- a mode where the ink is ejected by utilizing static electricity Beside the above-described techniques, any of various inkjet devices that have been proposed in the field of inkjet liquid ejection technology can also be used. Of such devices, those that utilize an electrothermal transducer can particularly suitably be used from the viewpoint of high speed and high precision printing.

There are not any particular limitations to the type of the whole system of the inkjet device. For example, a so-called shuttle type inkjet head designed to record an image by scanning the head in a direction perpendicular to the moving direction of the intermediate transfer member can suitable be used. Similarly, a so-called line head type inkjet head formed by arranging ink ejection ports on a line in a direction substantially perpendicular to the moving direction of the intermediate transfer member (and hence, in an instance where a drum-type intermediate transfer member is employed, in a direction substantially parallel to the shaft of the drum) can also suitably be used.

While there are no particular limitations to the characteristics of the ink so long as they do not adversely affect the advantages of the present invention, the surface tension of the ink is preferably not less than 20 mN/m and not more than 50 mN/m.

<Step of Auxiliary Liquid Application>

Then, the auxiliary liquid is applied to the first intermediate image formed on the image forming surface of the intermediate transfer member. While there are no particular limitations to the technique to be used for applying the auxiliary liquid, the auxiliary liquid is preferably applied by means of an inkjet device as in the case of applying ink. Then, as a result, a second intermediate image is formed on the intermediate transfer member.

While there are no particular limitations to the characteristics of the auxiliary liquid so long as they do not adversely affect the advantages of the present invention, the surface tension of the auxiliary liquid is preferably not less than 20 mN/m and not more than 50 mN/m.

<Step of Removing Liquid Content>

With this embodiment, a step of reducing the liquid content from the first intermediate image and/or the second intermediate image formed on the intermediate transfer member is preferably provided. By adding a step of removing the liquid content, the excessive liquid content in the first intermediate image and/or in the second intermediate image is removed to prevent the excessive liquid content from oozing out in the subsequent transferring step and obtain an excellent final image. Any of known techniques for removing the excessive liquid content can suitably be used. For example, such techniques include heating techniques, techniques of blowing lowly humid air, techniques of utilizing low pressure, techniques of bringing an absorbent into contact with the intermediate image and techniques of using two or more than two of the above-listed ones in combination. The excessive liquid content can also be removed by natural drying. Note that, when the excessive liquid content is removed by heating, there can be instances where the intermediate transfer member is also heated as a result of the heating operation to effectively bring the temperature of the intermediate transfer member above the melting point of the wax particles. If such is the case, the heating unit for removing the liquid content can also operate as the first temperature adjusting section.

<Step of Transferring Second Intermediate Image>

In this transferring step, the temperature of the intermediate transfer member is made to be equal to the first temperature that is not lower than the melting point of the wax particles, and the temperature of the recording medium is made to be equal to the second temperature that is lower than the melting point of the wax particles. Then, in this state, the second intermediate image that is on the intermediate transfer member is transferred onto the recording medium. While the technique to be used to transfer the second intermediate image is not subjected to any particular limitations, for example, a technique of causing the intermediate transfer member and the recording medium to adhere to each other under pressure so as to transfer the second intermediate image on the intermediate transfer member onto the recording medium can be utilized. The technique of causing the intermediate transfer member and the recording medium to adhere to each other under pressure is not subjected to any particular limitations but preferably a pressure roller is arranged so as to contact the outer peripheral surface of the intermediate transfer member, and the recording medium is forced to pass through between the intermediate transfer member and the pressure roller. The second intermediate image can efficiently be transferred onto the recording medium when pressure is applied both from the side of the intermediate transfer member and from the side of the recording medium as in a manner described above. Besides, pressure can suitably be applied in multiple stages as illustrated in FIG. 4 because such a pressure application technique is effective for preventing a failure transfer in the transferring step. Then pressure application means are arranged in multiple stages so as to make the temperature at the time of peeling off the second intermediate image from the intermediate transfer member is made to be equal to Tr in the final stages.

A heater is preferably contained in the pressure roller for adjusting the temperature of the recording medium at the time of transferring. The heater may be arranged so as to heat only a part of the pressure roller, although the heater is preferably so arranged as to heat the entire pressure roller. As pointed out above, the first temperature is not lower than the melting point Tm of the wax particles and the second temperature is lower than the melting point Tm of the wax particles in the image transferring operation. In view of the above, the temperature of the pressure roller is preferably selectable within the range of the second temperature according to the type of the water-soluble resin that is to be used. Thus, the heater preferably can heat the surface of the pressure roller within the range between 25° C. and 140° C. The conveyance rate of the recording medium at the time of image transferring operation is preferably not less than 0.1 m/s and not more than 3 m/s. The nipping pressure between the pressure roller and the intermediate transfer member is preferably not lower than 1 $kg/cm^2$ and not higher than 30 $kg/cm^2$, more preferably not lower than 2 $kg/cm^2$ and not higher than 15 $kg/cm^2$.

<Fixing Step>

As an additional step, a step of applying pressure onto the recording medium, to which the second intermediate image has already been transferred and recorded, by means of a roller may be provided to improve the fixation of the final image on the recording medium. Furthermore, the recording medium may suitably be heated because there may be instances where such heating improves the fixation of the final image. Additionally, the recording medium may be pressurized and heated simultaneously by means of a heating roller.

According to one aspect of the present invention, there is provided an auxiliary liquid that can improve the efficiency of transferring an intermediate image onto a recording medium and enables to stably record images of desired image quality, a liquid set including the auxiliary liquid, and an image recording method and an image recording apparatus using the same.

EXAMPLES

Now, the present invention will be described further by way of examples and by referring to the accompanying drawings. These examples do not limit the scope of the present invention so long as departing from the scope of the aim of the present invention. In the following description, the expression of "portion(s)" and "%" are mass portion(s) and mass % unless noted otherwise.

(Measurement of Melting Point of Wax Particles)

A melting point of wax particles can be determined according to the temperature measurement pattern defined in ASTM D3418. More specifically, the melting point of the wax particles can be made to be equal to the peak top value of the highest melting temperature as observed according to the temperature measurement pattern defined in ASTM D3418 with the temperature rising rate of 10° C./min by using DSC-7 (product name, manufactured by PerkinElmer, Inc.).

(Measurement of Glass Transition Temperature Tg)

A glass transition temperature of a water-soluble resin and that of resin particles are observed by using DSC-7 (product name, manufactured by PerkinElmer, Inc.). The measurement of the glass transition is conducted by using a temperature cycle from 30° C. to 120° C. (with the temperature rising rate of 2° C./min) twice.

Example 1 to 20 and Comparative Example 1 to 4

An image recoding operation was conducted in this example by using the image recording apparatus of FIG. 1. Note that, in this example, a cylindrical drum made of an aluminum alloy was used as the support member 102 in view of the required characteristics for reducing the rotary inertia and improving the control responsiveness in addition to the rigidity for withstanding the pressure to be applied at the time of image transferring and dimensional accuracy. A 0.5 mm-thick PET sheet that was coated with silicone rubber having a rubber hardness of 40° (KE12: product name, manufactured by Shin-Etsu Chemical Co., Ltd.) to a thickness of 0.2 mm was used as the material of the surface layer member 104. The surface of the surface layer member 104 was subjected to a plasma surface treatment by using an atmospheric plasma processing apparatus (ST-7000: product name, manufactured by Keyence CORPORATION) under the conditions of processing distance: 5 mm, plasma mode: High, and processing rate: 100 mm/sec. Additionally, the surface of the material of the surface layer member 104 was subjected to a surfactant treatment of immersing the material of the surface layer member 104 in a 3% aqueous solution of surfactant, which was prepared by diluting a commercially available neutral detergent made of sodium alkylbenzene sulfonate with pure water, for 10 seconds. Thereafter, the surface layer member 104 was obtained by drying the surface of the sheet. The surface layer member 104 formed in this way was rigidly secured to the support member 102 by means of a double-sided sticky tape. In this example, VENT NOUVEAU V (product name: manufactured by NISSHINBO PAPER PRODUCTS Inc., 157 g/m$^2$, arithmetic surface coarseness Rs=4 μm) was used as the recording medium. The reaction solution, the ink and the auxiliary liquid used with the apparatus of FIG. 1 were prepared in a manner as described below.

(Preparation of Reaction Solution 1)

30 parts of glutaric acid, 7 parts of glycerin, 5 parts of surfactant (ACETYLENOL E100: product name, manufactured by KAWAKEN FINE CHEMICALS Co., Ltd.) and 58 parts of deionized water were mixed and agitated thoroughly. Thereafter, the mixture was pressurized and filtrated by means of a micro-filter of pore size 3.0 μm (manufactured by Fuji Film Corporation). The reaction solution 1 was prepared in the above-described manner.

(Preparation of Reaction Solution 2)

30 parts of calcium chloride, 7 parts of glycerin, 5 parts of surfactant (ACETYLENOL E100: product name, manufactured by KAWAKEN FINE CHEMICALS Co., Ltd.) and 58 parts of deionized water were mixed and agitated thoroughly. Thereafter, the mixture was pressurized and filtrated by means of a micro-filter of pore size 3.0 μm (manufactured by Fuji Film Corporation). The reaction solution 2 was prepared in the above-described manner.

(Preparation of Black Pigment Dispersion)

The ingredients listed below were mixed and put into a batch-type vertical sand mill (manufactured by AIMEX Co. Ltd).

- carbon black (Monarch 1100: product name, manufactured by Cabot Corporation): 10 parts
- resin aqueous solution (obtained by neutralizing aqueous solution of styrene-ethyl acrylate-acrylic acid copolymer with potassium hydroxide; acid value 150; weight average molecular weight 8,000; resin content ratio 20 mass %): 15 parts
- pure water: 75 parts 200 parts of zirconia beads having a diameter of 0.3 mm were filled in the sand mill and the mixture was subjected to a dispersion process for 5 hours while the mixture was cooled with water. The dispersion was centrifuged and, after removing large grains, a black pigment dispersion with a pigment content ratio of 10.0 mass % was obtained.

(Preparation of Resin Particle Dispersion 1)

15 parts of butyl methacrylate, 5 parts of ethyl methacrylate, 3 parts of 2,2'-azobis-(2-methylbutyronitrile) and 2 parts of n-hexadecane were mixed and agitated for 0.5 hours. The mixture was dropped into 75 parts of 8% aqueous solution of styrene-butyl acrylate-acrylic acid copolymer (acid value: 130 mgKOH/g, weight average molecular weight: 7,000) and the aqueous solution was agitated for 0.5 hours. Then, ultrasonic waves were irradiated onto the solution using an ultrasonic radiator for 3 hours. Subsequently, a polymerization reaction was caused to take place in a nitrogen atmosphere at 80° C. for 4 hours. The polymerization product was cooled to room temperature and filtrated to obtain a resin particle dispersion 1 whose resin content ratio was 25.0 mass %. The volume average particle diameter of the obtained resin particles was 220 nm and Tg of the obtained resin particles was 30° C.

(Preparation of Resin Particle Dispersion 2)

20 parts of ethyl methacrylate and 3 parts of 2,2'-azobis-(2-methylbutyronitrile) were mixed and agitated for 0.5 hours. The mixture was dropped into 75 parts of 8% aqueous solution of styrene-butyl acrylate-acrylic acid copolymer (acid value: 130 mgKOH/g, weight average molecular weight: 7,000) and agitated for 0.5 hours. Then, ultrasonic waves were irradiated onto the solution using an ultrasonic radiator for 3 hours. Subsequently, a polymerization reaction was caused to take place in a nitrogen atmosphere at 80° C. for 4 hours. The polymerization product was cooled to room temperature and filtrated to obtain a resin particle dispersion 2 whose resin content ratio was 25.0 mass %. The volume average particle diameter of the obtained resin particles was 210 nm and Tg of the obtained resin particles was 60° C.

(Preparation of Resin Particle Dispersion 3)

20 parts of methyl methacrylate, 3 parts of 2,2'-azobis-(2-methylbutyronitrile) and 2 parts of n-hexadecane were mixed and agitated for 0.5 hours. The mixture was dropped into 75 parts of 8% aqueous solution of styrene-butyl acrylate-acrylic acid copolymer (acid value: 130 mgKOH/g, weight average molecular weight: 7,000) and agitated for 0.5 hours. Then, ultrasonic waves were irradiated onto the solution for 3 hours. Subsequently, polymerization reaction was caused to take place in a nitrogen atmosphere at 80° C. for 4 hours. The polymerization product was cooled to room temperature and filtrated to obtain resin particle dispersion 3 whose resin content ratio was 25.0 mass %. The volume average particle diameter of the obtained resin particles was 230 nm and Tg of the obtained resin particles was 100° C.

(Preparation of Wax Particle Dispersion 1)

Selosol 524 (product name: manufactured by Chukyo Yushi Co., Ltd.) was diluted with deionized water to obtain wax particle dispersion 1 whose non-volatile content was 25.0 mass %. The melting point of the wax particles was 83° C. The volume average particle diameter of the wax particles was 70 nm.

(Preparation of Wax Particle Dispersion 2)

Trasol PF60 (product name: manufactured by Chukyo Yushi Co., Ltd.) was diluted with deionized water to obtain wax particle dispersion 2 whose non-volatile content was 25.0 mass %. The melting point of the wax particles was 60° C. The volume average particle diameter of the wax particles was 300 nm.

(Preparation of Wax Particle Dispersion 3)

AQUACER 539 (product name: available from BYK Japan KK; manufactured by BYK Additives & Instruments GmbH) was diluted with deionized water to obtain wax particle dispersion 3 whose non-volatile content was 25.0 mass %. The melting point of the wax particles was 90° C. The volume average particle diameter of the wax particles was 50 nm.

(Preparation of Ink)

The resin particle dispersion 1 and the black pigment dispersion obtained in the above-described manner were mixed with the ingredients listed below. Note that the expression of "deionized water: rest" refers to the amount of deionized water that makes the total of all the ink ingredients equal to 100 mass %.

pigment dispersion (content ratio of coloring material=10.0 mass %): 40.0 mass %
resin particle dispersion 1: 20.0 mass %
glycerin 7.0 mass %
L31 (product name: manufactured by ADEKA CORPORATION, surfactant): 3.0 mass %
ACETYLENOL E100 (product name, manufactured by KAWAKEN FINE CHEMICALS Co., Ltd., surfactant): 0.5 mass %
deionized water: rest A black ink was prepared by agitating the above mixture thoroughly for dispersion and subsequently subjecting the mixture to pressure filtration, using a micro filter with pore size of 3.0 μm (manufactured by Fuji Film Corporation).

(Preparation of Auxiliary Liquids 1 Through 19)

One of the resin particle dispersions and one of the wax particle dispersions obtained in the above-described manner were selected according to Table 1 and mixed with the ingredients listed below to prepare auxiliary liquid 1 through 19, respectively. Note that the expression of "deionized water: rest" refers to the amount of deionized water that makes the total of all the ink ingredients equal to 100 mass %.

wax particle dispersion (see Table 1): A mass % in Table 1
water-soluble resin (see Table 1): B mass % in Table 1
resin particle dispersion (see Table 1): C mass % in Table 1
glycerin: 7.0 mass %
L31 (product name: manufactured by ADEKA CORPORATION, surfactant): D mass % in Table 1
ACETYLENOL E100 (product name, manufactured by KAWAKEN FINE CHEMICALS Co., Ltd., surfactant): 0.5 mass %
deionized water: rest For water-soluble resin, one of the water-soluble resins 1 through 3 listed below was used.

water-soluble resin 1: (styrene-butyl acrylate-acrylic acid copolymer (acid value 132, weight average molecular weight 7,700, Tg=78° C.); solid content ratio 20%; neutralized by potassium hydroxide)
water-soluble resin 2: (styrene-ethyl acrylate-acrylic acid copolymer (acid value 150, weight average molecular weight 14,000, Tg=95° C.); solid content ratio 20%; neutralized by potassium hydroxide)
water-soluble resin 3: (benzyl methacrylate-acrylic acid copolymer (acid value 90, weight average molecular weight 8,500, Tg=55° C.); solid content ratio 20%; neutralized by potassium hydroxide)

Each of the auxiliary liquids 1 through 19 was prepared by thoroughly mixing the ingredients and subsequently subjecting the mixture to pressure filtration, using a micro filter with pore size of 3.0 μm (manufactured by Fuji Film Corporation).

TABLE 1

| | Wax particle | | Water-soluble resin | | Resin particle | | Surfactant (L31) | Water-soluble | Resin- |
|---|---|---|---|---|---|---|---|---|---|
| Auxiliary liquid (No) | Type | Content ratio A (mass %) | Type | Content ratio B (mass %) | Type | Content ratio C (mass %) | Content ratio D (mass %) | resin:wax particle mass ratio | particle:wax particle mass ratio |
| auxi liquid 1 | wax dispersion 1 | 20 | water-sol resin 1 | 1.5 | dispersion 1 | 20 | 3 | 1:3.3 | 1:1 |
| auxi liquid 2 | wax dispersion 2 | 20 | water-sol resin 1 | 1.5 | dispersion 1 | 20 | 3 | 1:3.3 | 1:1 |
| auxi liquid 3 | wax dispersion 3 | 20 | water-sol resin 1 | 1.5 | dispersion 1 | 20 | 3 | 1:3.3 | 1:1 |
| auxi liquid 4 | wax dispersion 1 | 20 | water-sol resin 1 | 1.5 | dispersion 2 | 20 | 3 | 1:3.3 | 1:1 |
| auxi liquid 5 | wax dispersion 1 | 20 | water-sol resin 1 | 1.5 | dispersion 3 | 20 | 3 | 1:3.3 | 1:1 |

TABLE 1-continued

| Auxiliary liquid (No) | Wax particle Type | Wax particle Content ratio A (mass %) | Water-soluble resin Type | Water-soluble resin Content ratio B (mass %) | Resin particle Type | Resin particle Content ratio C (mass %) | Surfactant (L31) Content ratio D (mass %) | Water-soluble resin:wax particle mass ratio | Resin-particle:wax particle mass ratio |
|---|---|---|---|---|---|---|---|---|---|
| auxi liquid 6 | wax dispersion 1 | 20 | water-sol resin 2 | 1.5 | dispersion 1 | 20 | 3 | 1:3.3 | 1:1 |
| auxi liquid 7 | wax dispersion 1 | 20 | water-sol resin 3 | 1.5 | dispersion 1 | 20 | 3 | 1:3.3 | 1:1 |
| auxi liquid 8 | wax dispersion 1 | 20 | water-sol resin 1 | 1.5 | dispersion 1 | 20 | — | 1:3.3 | 1:1 |
| auxi liquid 9 | wax dispersion 1 | 60 | water-sol resin 1 | 1.5 | dispersion 1 | 20 | 3 | 1:10 | 1:3 |
| auxi liquid 10 | wax dispersion 1 | 20 | water-sol resin 1 | 5 | dispersion 1 | 20 | 3 | 1:1 | 1:1 |
| auxi liquid 11 | wax dispersion 1 | 60 | water-sol resin 1 | 0.75 | dispersion 1 | 20 | 3 | 1:20 | 1:3 |
| auxi liquid 12 | wax dispersion 1 | 6 | water-sol resin 1 | 4 | dispersion 1 | 20 | 3 | 2.7:1 | 3.3:1 |
| auxi liquid 13 | wax dispersion 1 | 20 | water-sol resin 1 | 1.5 | — | — | 3 | 1:3.3 | — |
| auxi liquid 14 | wax dispersion 1 | 10 | water-sol resin 1 | 1.5 | dispersion 1 | 50 | 3 | 1:1.7 | 5:1 |
| auxi liquid 15 | wax dispersion 1 | 50 | water-sol resin 1 | 1.5 | dispersion 1 | 5 | 3 | 1:8.3 | 1:10 |
| auxi liquid 16 | wax dispersion 1 | 8 | water-sol resin 1 | 1.5 | dispersion 1 | 50 | 3 | 1:1.3 | 6.3:1 |
| auxi liquid 17 | wax dispersion 1 | 55 | water-sol resin 1 | 1.5 | dispersion 1 | 5 | 3 | 1:9.2 | 1:11 |
| auxi liquid 18 | wax dispersion 1 | 20 | — | — | dispersion 1 | 20 | 3 | — | 1:1 |
| auxi liquid 19 | — | — | water-sol resin 1 | 1.5 | dispersion 1 | 20 | 3 | — | — |

In this example, an image recording operation was conducted in a manner as described below by using an apparatus as illustrated in FIG. 1. Firstly, one of the reaction solutions 1 through 2 prepared in the above-described manner was selected as to be described in Table 2, and applied onto the intermediate transfer member 101 at a rate of 1.0 g/m$^2$ by means of a roller type applicator 105. Subsequently, an image (5 cm×5 cm solid image) with recording duty of 200% (recording duty of each of the ink and the auxiliary liquid being 100%, respectively) was recorded on the intermediate transfer member 101 by injecting the ink prepared in the above-described manner and one of the auxiliary liquids 1 through 19 selected as to be described in Table 2 from respective inkjet devices 103 and 107.

Note that, for the image recording apparatus used in this example, the condition of applying an ink drop of 3.0 ng (nanograms) to a unit region of 1/1,200 inches×1/1,200 inches with resolution of 1,200 dpi×1,200 dpi is defined as recording duty 100%.

Then, the liquid content was removed from the intermediate image (the second intermediate image) on the intermediate transfer member 101 by means of the blower 110 and, at the same time, the intermediate transfer member 101 was heated by means of the heater 112 contained in the intermediate transfer member 101. Subsequently, as the intermediate transfer member 101 was driven to rotate in the direction indicated by the round arrow in FIG. 1, recording medium 108 and the intermediate image were brought into contact with each other between the intermediate transfer member 101 and the pressure roller 113 in the image transfer region 131 to transfer the intermediate image from the intermediate transfer member 101 onto the recording medium 108. The conveyance speed of the recording medium 108 was adjusted to 1 m/sec. In this example, the predetermined temperature values listed in Table 2 shown below were used respectively for the first temperature of the intermediate transfer member 101 and the second temperature of the recording medium 108. Note that the first temperature of the intermediate transfer member 101 was determined by observing the surface temperature of the intermediate transfer member 101 by means of an infrared radiation thermometer immediately before the position where the intermediate transfer member 101 and the recording medium were brought into contact with each other. The second temperature of the recording medium 108 was determined by observing the surface temperature of the recording medium by means of an infrared radiation thermometer immediately after the position where the recording medium was peeled off from the intermediate transfer member. Also note that the temperature of the second intermediate image before it was brought into contact with the recording medium was equal to the first temperature of the intermediate transfer member 101 and, at the time when the second intermediate image was brought into contact with the recording medium, the influence of the contact of the second intermediate image with the recording medium on the temperature of the second intermediate image was very small. For this reason, in this example, the first temperature of the intermediate transfer member 101 was regarded as being equal to the temperature Tc of the second intermediate image at the time when the second intermediate image was brought into contact with the recording medium. Additionally, the temperature of the second intermediate image after the recording medium was peeled off from the intermediate transfer member was regarded as being the same as the second temperature of the recording medium 108 and, at the time when the second intermediate image was peeled off from the intermediate transfer member, the temperature of the second intermediate image was substantially equal to the temperature of the recording medium 108 because they contact with each other at that time. For this reason, in this example, the second temperature of the recording medium 108 was regarded as being equal to the temperature Tr of the second intermediate image at the time when the latter was peeled off from the intermediate transfer member. The nip pressure applied by the intermediate transfer member 101 and the pressure roller 113 was adjusted to 3 kg/cm$^2$.

<Evaluation of Intermediate Image Transfer Property>

The transfer ratio of the intermediate image of each example recorded in the above-described manner was observed. The transfer ratio of the intermediate image transferred onto the recording medium was calculated from the ratio of the area of the intermediate image on the intermediate transfer member before the transfer to the area of the intermediate image left on the intermediate transfer member after the transfer. Namely, the intermediate transfer member was observed through an optical microscope after the image transferring step, then the residual area of the intermediate image was determined and the calculation of 100−[(residual area of intermediate image)/(area of intermediate image)]×100 was executed. The obtained result was evaluated by referring to the criteria shown below. In the present invention, a rating of B or a rating lower than B was given to a state where portions of sheet surface exposed to the image region of the printed matter were observed, and, the quality of the image was evaluated as unacceptable. The results are shown in Table 2.

AA: Transfer ratio was not less than 99%.

A: Transfer ratio was not less than 95% and less than 99%.

B: Transfer ratio was not less than 80% and less than 95%.

C: Transfer ratio was not less than 50% and less than 80%.

D: Transfer ratio was less than 50%.

[Evaluation of Image]

The image was recorded in a manner as described above and the occurrence of image shift was checked to evaluate the image quality. The evaluation method and the evaluation criteria are described below.

(Occurrence of Image Shift)

Each of the obtained images was observed through a microscope and checked for color loss. Note that, when an image shift took place to any of the obtained solid images, a phenomenon of color loss also occurred in the solid image. The evaluation criteria is described below.

A: There was no color loss and the solid image was good.

B: There was a color loss in part of the image but the image was acceptable.

C: There was a color loss and a solid image was not formed.

In the present invention, when a rating of C was given to the image shift of a recorded image, the quality of the image was evaluated as poor and unacceptable. The results of the evaluations are listed in Table 2 shown below.

TABLE 2

| Example No. | Auxiliary liquid No. | Reaction solution No. | Melting point of wax particles (° C.) | Glass transition temp of water-soluble resin (° C.) | Glass transition temp of resin particles (° C.) | First temperature (° C.) | Second temperature (° C.) | Evaluation result: Transfer performance | Evaluation result: Image shift |
|---|---|---|---|---|---|---|---|---|---|
| Example 1 | Auxi. liquid 1 | Reaction sol. 1 | 83 | 78 | 30 | 85 | 55 | AA | A |
| Example 2 | Auxi. liquid 1 | Reaction sol. 2 | 83 | 78 | 30 | 85 | 55 | AA | A |
| Example 3 | Auxi. liquid 2 | Reaction sol. 1 | 60 | 78 | 30 | 85 | 55 | AA | A |
| Example 4 | Auxi. liquid 3 | Reaction sol. 1 | 90 | 78 | 30 | 100 | 70 | AA | A |
| Example 5 | Auxi. liquid 4 | Reaction sol. 1 | 83 | 78 | 60 | 85 | 55 | AA | A |
| Example 6 | Auxi. liquid 5 | Reaction sol. 1 | 83 | 78 | 100 | 85 | 55 | A | A |
| Example 7 | Auxi. liquid 6 | Reaction sol. 1 | 83 | 95 | 30 | 85 | 55 | A | A |
| Example 8 | Auxi. liquid 7 | Reaction sol. 1 | 83 | 55 | 30 | 85 | 55 | AA | A |
| Example 9 | Auxi. liquid 8 | Reaction sol. 1 | 83 | 78 | 30 | 85 | 55 | A | B |
| Example 10 | Auxi. liquid 1 | Reaction sol. 1 | 83 | 78 | 30 | 85 | 80 | A | A |
| Example 11 | Auxi. liquid 1 | Reaction sol. 1 | 83 | 78 | 30 | 85 | 81 | B | A |
| Example 12 | Auxi. liquid 9 | Reaction sol. 1 | 83 | 78 | 30 | 85 | 55 | A | A |
| Example 13 | Auxi. liquid 10 | Reaction sol. 1 | 83 | 78 | 30 | 85 | 55 | A | B |
| Example 14 | Auxi. liquid 11 | Reaction sol. 1 | 83 | 78 | 30 | 85 | 55 | B | A |
| Example 15 | Auxi. liquid 12 | Reaction sol. 1 | 83 | 78 | 30 | 85 | 55 | A | B |
| Example 16 | Auxi. liquid 13 | Reaction sol. 1 | 83 | 78 | — | 85 | 55 | A | A |
| Example 17 | Auxi. liquid 14 | Reaction sol. 1 | 83 | 78 | 30 | 85 | 55 | A | A |
| Example 18 | Auxi. liquid 15 | Reaction sol. 1 | 83 | 78 | 30 | 85 | 55 | A | A |
| Example 19 | Auxi. liquid 16 | Reaction sol. 1 | 83 | 78 | 30 | 85 | 55 | B | A |
| Example 20 | Auxi. liquid 17 | Reaction sol. 1 | 83 | 78 | 30 | 85 | 55 | A | A |
| Comp Ex. 1 | Auxi. liquid 18 | Reaction sol. 1 | 83 | — | 30 | 85 | 55 | D | A |
| Comp Ex. 2 | Auxi. liquid 19 | Reaction sol. 1 | — | 78 | 30 | 85 | 55 | C | B |
| Comp Ex. 3 | Auxi. liquid 1 | Reaction sol. 1 | 83 | 78 | 30 | 75 | 55 | D | A |
| Comp Ex. 4 | Auxi. liquid 1 | Reaction sol. 1 | 83 | 78 | 30 | 100 | 90 | D | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-073083, filed Mar. 31, 2016, which is hereby incorporated by reference herein in its entirety.

What is claimed is:

1. An auxiliary liquid for transferring, comprising:

a water-soluble resin;

wax particles; and water, wherein the wax particles contain at least one wax component selected from the group consisting of a paraffin wax, a microcrystalline wax, a petrolatum, a carnauba wax, a candelilla wax, a rice wax, a Japan wax, a lanolin, a bees wax, a polyethylene wax, a fischer tropsch wax, paraffin wax derivatives, montan wax derivatives, and microcrystalline wax derivatives.

2. The auxiliary liquid according to claim 1, wherein a mass ratio of the water-soluble resin to the wax particles (a content ratio of the water-soluble resin: a content ratio of the wax particles) in the auxiliary liquid is in a range of 1:1 to 1:10.

3. The auxiliary liquid according to claim 1, wherein a content ratio of the wax particles in the auxiliary liquid is 0.5 mass % or more and 20 mass % or less relative to the total mass of the auxiliary liquid.

4. The auxiliary liquid according to claim 1, wherein a content ratio of the water-soluble resin in the auxiliary liquid is 0.1 mass % or more and 20 mass % or less relative to the total mass of the auxiliary liquid.

5. The auxiliary liquid according to claim 1, wherein the water-soluble resin has a weight average molecular weight of 2,000 or more and 20,000 or less.

6. The auxiliary liquid according to claim 1, wherein a glass transition point of the water-soluble resin is 40° C. or more and 150° C. or less.

7. The auxiliary liquid according to claim 1, wherein a melting point of the wax particles is 40° C. or more and 150° C. or less.

8. The auxiliary liquid according to claim 1, wherein a volume average particle diameter of the wax particles in the auxiliary liquid is 10 nm or more and 1,000 nm or less.

9. The auxiliary liquid according to claim 1, wherein the auxiliary liquid further comprises resin particles.

10. The auxiliary liquid according to claim 9, wherein a mass ratio of the resin particles to the wax particles (a content ratio of the resin particles: a content ratio of the wax particles) in the auxiliary liquid is in a range of 5:1 to 1:10.

11. The auxiliary liquid according to claim 9, wherein a glass transition point of the resin particles is 30° C. or more and 150° C. or less.

12. The auxiliary liquid according to claim 9, wherein a resin constituting the resin particles is at least one selected from (i) homopolymers of polyolefin, polystyrene, polyurethane, polyester, polyether, polyurea, polyamide, polyvinyl alcohol, poly(meth)acrylic acid and salts thereof, polyalkyl (meth)acrylate and polydiene; and (ii) copolymers formed by combining two, or more than two, of the homopolymers.

13. An auxiliary liquid according to claim 1, wherein a content ratio of the water in the auxiliary liquid is 8.0 mass % or more and 59.5 mass % or less relative to the total mass of the auxiliary liquid.

* * * * *